US010844616B2

(12) United States Patent
Rashid et al.

(10) Patent No.: US 10,844,616 B2
(45) Date of Patent: Nov. 24, 2020

(54) LIGHTWEIGHT ROOFING SUPPORT SYSTEM AND METHOD OF MAKING AND USING

(71) Applicants: Philip F Rashid, Milford, MI (US); Phillip A Tesolin, Wixom, MI (US)

(72) Inventors: Philip F Rashid, Milford, MI (US); Phillip A Tesolin, Wixom, MI (US)

(73) Assignee: PHIL SQUARED ROOF JACK SYSTEMS LLC, Milford, MI (US)

( * ) Notice: Subject to any disclaimer, the term of this patent is extended or adjusted under 35 U.S.C. 154(b) by 0 days.

(21) Appl. No.: 15/981,491

(22) Filed: May 16, 2018

(65) Prior Publication Data

US 2018/0334814 A1 Nov. 22, 2018

Related U.S. Application Data

(60) Provisional application No. 62/506,835, filed on May 16, 2017.

(51) Int. Cl.

| | |
|---|---|
| ***E04G 3/26*** | (2006.01) |
| ***E04D 15/02*** | (2006.01) |
| ***E04D 13/12*** | (2006.01) |
| *E04G 3/34* | (2006.01) |

(52) U.S. Cl.

CPC ..... *E04G 3/26* (2013.01); *E04D 13/12* (2013.01); *E04D 15/02* (2013.01); *E04G 3/265* (2013.01); *E04G 3/34* (2013.01)

(58) Field of Classification Search

CPC .. E04G 3/26; E04G 3/265; E04G 3/24; E04D 13/12; E04D 15/02; E04D 15/00; H02S 20/23

USPC ..... 248/237, 148; 182/45

See application file for complete search history.

(56) References Cited

U.S. PATENT DOCUMENTS

| | | | | |
|---|---|---|---|---|
| 4,135,335 | A | 1/1979 | Jensen | |
| 5,232,187 | A * | 8/1993 | O'Farrell | E04F 21/00 248/148 |
| 5,263,551 | A * | 11/1993 | Andersen | B25H 1/06 182/107 |
| 5,887,406 | A * | 3/1999 | Bond | E04D 15/00 182/45 |
| 6,170,222 | B1 | 1/2001 | Miller | |
| 6,622,960 | B2 * | 9/2003 | Hyde | B65H 57/00 137/377 |
| 8,448,746 | B2 | 5/2013 | Davis | |

(Continued)

FOREIGN PATENT DOCUMENTS

EP 0710457 A2 5/1996

*Primary Examiner* — Christopher Garft

(74) *Attorney, Agent, or Firm* — North Star IP Law PLLC; Edmund P. Anderson

(57) ABSTRACT

A lightweight composite roofing support system is disclosed. The roofing support system includes a longitudinally-extending core member having a wedge-shaped lateral cross-section, a first side, and a second side, the first side and the second side tapering toward one another at a first predetermined acute angle (α), the core member comprising a core material. The roofing support system also includes a cover layer comprising a cover material, the cover layer disposed on and covering at least one of the first side and the second side, the cover material being substantially more compressible than the core material, the core member and cover layer comprising a first roofing support.

15 Claims, 13 Drawing Sheets

(56) References Cited

U.S. PATENT DOCUMENTS

| | | | | |
|---|---|---|---|---|
| 2004/0262467 | A1* | 12/2004 | Burr | A47B 91/066<br>248/188.4 |
| 2009/0151039 | A1 | 6/2009 | Kielland | |

* cited by examiner

LIGHTWEIGHT ROOFING SUPPORT SYSTEM AND METHOD OF MAKING AND USING

CROSS REFERENCE TO RELATED APPLICATIONS

This application claims the benefit of U.S. Provisional Patent Application No. 62/506,835 filed on May 16, 2017.

FIELD OF THE INVENTION

The subject invention relates generally to a lightweight roofing support system and a method of making and using the system. More particularly, it relates to a lightweight composite roofing support system and a method of making and using the system that is configured to provide a level, stable, self-supporting platform for roofing workers, roofing tools, roofing materials, or a combination thereof, on a pitched or sloped roof.

BACKGROUND

The removal and/or application of roofing systems and roofing materials on sloped or pitched roofs presents long-standing problems, particularly on relatively steeply pitched roofs, such as those having a pitch above 8/12 (i.e. 8 feet of vertical rise for every 12 feet of horizontal run), problems that are particularly acute on roofs with pitches ranging from 10/12 to 16/12. Steeply pitched roofs are very difficult for roofing workers to walk on or to store roofing tools or roofing materials.

Various support systems and structures have been proposed to provide a platform for roofing workers, roofing tools, roofing materials, or a combination thereof, on pitched or sloped roofs. One common support structure comprises a plurality of spaced apart roof jacks that are used to support a jack board between them. The jack board generally provides a substantially horizontal surface on which roofing workers can move horizontally across the roof surface, and on which they may store roofing tools and roofing materials. Problems associated with this system is that the jack stands and jack boards are heavy and require a substantial expenditure of time and effort in order to locate, and in order to reposition as the deconstruction and/or construction of the roof systems proceed. In addition, attachment of the jack stands and the jack boards generally disadvantageously require anchoring to the roof deck by the insertion of nails or screws, or the resulting perforation of the upper portion of the shingles, underlayment material, or wooden roof deck, which are are all known leakage paths for water from condensation, rain, and/or ice, for example.

Polymer based roof blocks have been proposed but have generally been unsuitable. In some cases, polymer roof blocks have been too rigid, such that the blocks are not non-skid and unstable and thus have a tendency to slide downwardly in the downslope direction over the surface of the pitched roof, particularly if the roof is steeply pitched.

Therefore, it would be very desirable provide a lightweight composite roofing support system that avoids the limitations described above, and a provides a level, stable, self-supporting platform for roofing workers, roofing tools, roofing materials, or a combination thereof, on pitched or sloped roofs, and particularly steeply pitched or sloped roofs.

SUMMARY OF THE INVENTION

In one embodiment, a lightweight composite roofing support system is disclosed. The roofing support system includes a longitudinally-extending core member having a wedge-shaped lateral cross-section, a first side, and a second side, the first side and the second side tapering toward one another at a first predetermined acute angle ($\alpha$), the core member comprising a core material. The roofing support system also includes a cover layer comprising a cover material, the cover layer disposed on and covering at least one of the first side and the second side, the cover material being substantially more compressible than the core material, the core member and cover layer comprising a first roofing support.

In one embodiment, a method of making a lightweight composite roofing support system is disclosed. The method includes forming a longitudinally-extending core member having a wedge-shaped lateral cross-section, a first side, and a second side, the first side and the second side tapering toward one another at a first predetermined acute angle ($\alpha$), the core member comprising a core material. The method of making also includes attaching a cover layer comprising a cover material, the cover layer disposed on and covering at least one of the first side and the second side, the cover material being substantially more compressible than the core material, the core member and cover layer comprising a first roofing support.

In one embodiment, a method of using a lightweight composite roofing support system is disclosed. The method of using includes forming a longitudinally-extending core member having a wedge-shaped lateral cross-section, a first side, and a second side, the first side and the second side tapering toward one another at a first predetermined acute angle ($\alpha$), the core member comprising a core material; and attaching a cover layer comprising a cover material, the cover layer disposed on and covering at least one of the first side and the second side, the cover material being substantially more compressible than the core material, the core member and cover layer comprising a first roofing support. The method of using also includes placing the first roofing support on a pitched roof and configuring the system so that one of the first side or the second side provides a substantially horizontal work surface configured to hold a predetermined roofing load.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which:

FIG. 3C is a cross-sectional view of the roofing support system and roof support of FIG. 3A through section 3D-3D;

DESCRIPTION OF THE EMBODIMENTS

Figure 1:
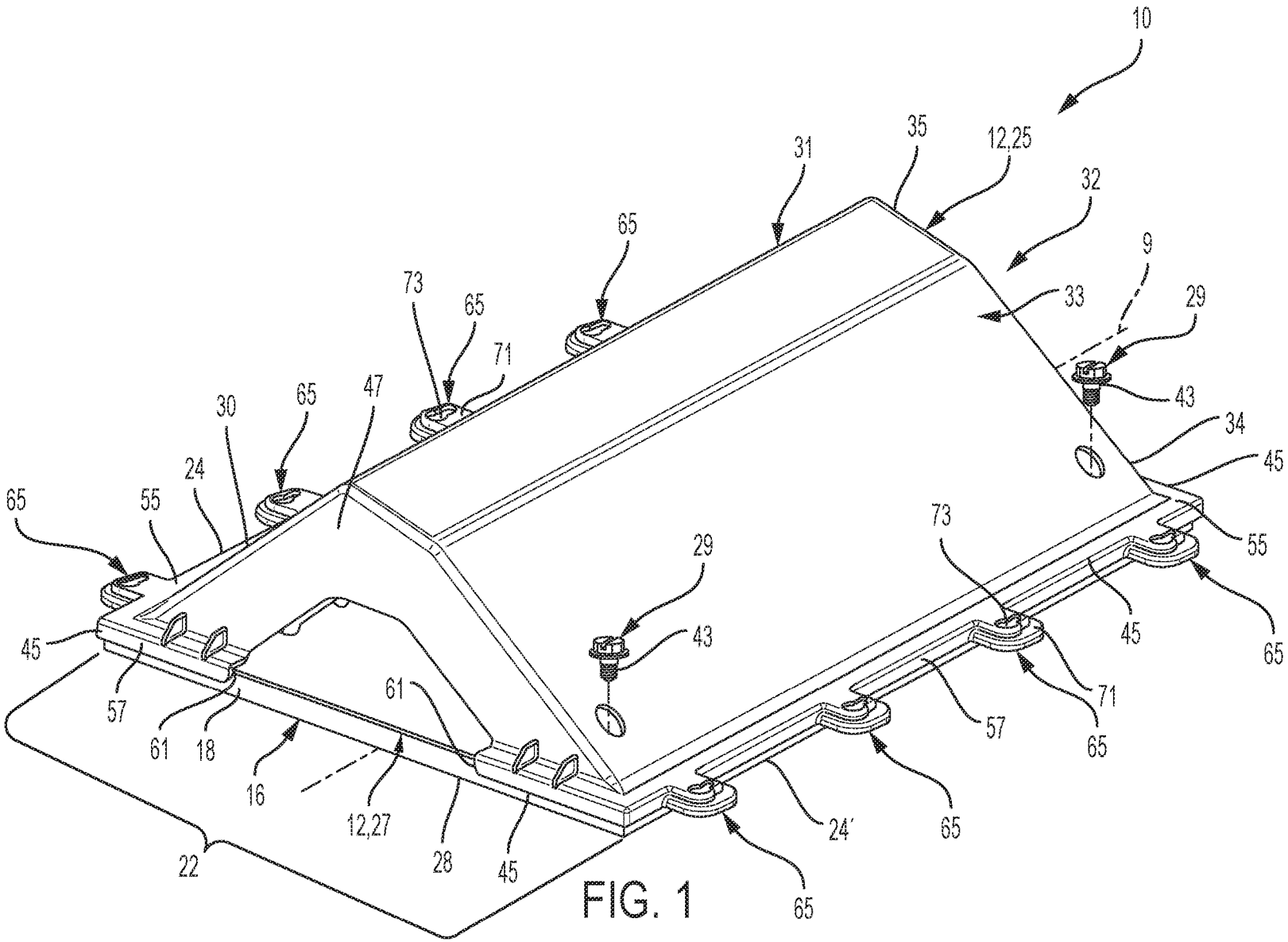
FIG. 1 is a perspective view of an embodiment of a roofing support system and roof support as disclosed herein.

This invention comprises a lightweight composite roofing support system or wedge that supports, or acts as support for, a load placed on a sloped or pitched roof. The load may include a roofing worker (person), or workers, or various roofing materials, or a combination thereof. The lightweight composite roofing support system may be used without the requirement of fasteners to hold it in place. Alternately, in certain embodiments, the lightweight composite roofing support system may also be secured and attached to a roof by the use of fasteners. As used herein, roofing workers includes any person on the roof of a house or other building for any purpose, including those that repair, remove or install roofing materials, as well as painters, siding installers, seasonal light installers, satellite installers, homeowners and any person that has occasion to perform work upon a pitched roof, particularly a steeply pitched roof as described herein. As used herein, roofing material may include any material or equipment or tool placed on the roof of a house or other building either temporarily or permanently, including roofing construction or repair materials, such as shingles, metal panels, boards, wooden or composite sheet or board underlayment, rolled roofing products, vents, nails, staples, or screws, or materials or equipment that are placed on or in or protrude from a roof, such as various chimney materials, skylights, windows, air conditioning components, and the like. The lightweight composite roofing support system represents an improvement over existing roofing support systems, slope roof article holders and roof leveling platforms. The lightweight composite roofing support system can be used by roofing workers as a stable, non-skid platform to stand on, kneel on, sit on, or stack roofing material on. The design allows the wedge to be manufactured at different lengths and for roofing workers as users to move freely along the length of the wedge analogous to the manner in which roofing workers would move along a traditional jack board that is used in combination with a plurality of roof jacks that are anchored to the roof. The lightweight composite roofing support system advantageously does not require that it be anchored to the roof deck by the insertion of nails or screws, or the resulting perforation of the upper portion of the shingles, underlayment or wooden roof deck, which is are all known leakage paths for water from condensation, rain, or ice, for example. In one embodiment, the lightweight composite roofing support system or wedge comprises a molded plastic support or core member with a plurality of support sides configured to provide a level working surface for at least two different roof slopes (and a substantially level work surface over a range of roof slopes) and a selectively attachable/detachable base. The cross-sectional shape of the molded plastic support or core member may be configured to provide a level working surface for two different roof slopes (and a substantially level work surface over a range of roof slopes) by merely rotating the base of the wedge 180 degrees. The selectively attachable/detachable base includes a predetermined roof contact material, such as various open cell foams. The predetermined roof contact material may be configured to provide a coefficient of sliding friction, particularly when loaded, that in some embodiments prevents sliding movement down the roof, and other embodiments substantially prevents or resists sliding movement down the roof. In one embodiment, a right triangular cross-sectional shape may be configured to provide a level working surface for two different roof slopes by merely rotating the wedge 180 degrees. In one embodiment, the level working surfaces of the support sides comprise a non-slip material, or include a surface roughness, texture, or pattern that provides a non-slip surface. In other embodiments, the support sides may be covered with a compressible material suited for standing or kneeling on. In certain embodiments, two different materials, a more rigid core material and a compressible cover layer, are used to achieve the desired result of making a product sturdy enough for a roofer to stand on, kneel on, or support roofing materials on, but soft enough to provide a non-skid surface so as not to not slide on a sloped roof. The fixed angle wedge body is made from a lightweight rigid material, such as an engineering thermoplastic or thermoset material. In one embodiment, the support or core member may include high density polyethylene, polystyrene or polyurethane, and the surfaces of the base that are configured to contact the roof are covered by a compressible material, such as a polymer foam material, including various open-cell or closed-cell polymer foam materials, that provides a high coefficient of friction with asphalt shingles, roofing underlayment and wood. Cost and weight are kept at a minimum while maintaining robustness by eliminating moving parts found in related art devices. The lightweight composite roofing support system or wedge may include attachment points, such as a plurality of lugs protruding from the edges, for optional attachment to a roof using various fasteners. The lightweight composite roofing support system or wedge may include handles for easy transportation, including lifting the system onto a roof, and repositioning of the system or wedge on the roof while working. The lightweight composite roofing support system or wedge may also include a strap, or a plurality of straps, or a longitudinally-extending web protruding from the upslope edge to allow two wedges to be attached to one another and set opposite one another as a mirror image over a roof peak to provide a level stacking surface for material that extends on either side and over the roof peak. While not required for use of the wedge, it is also contemplated that the strap, or a plurality of straps, or a longitudinally-extending web can used to further secure the wedge to a roof using typical fasteners, such as nails, screws, or staples, particularly so that the fasteners do not pierce or puncture the roof sealing elements, including the underlayment, snow seal, or shingles, for example.

As used herein, longitudinal or along the length refers to a direction that extends along an article centerline or axis. The term lateral or along the width or left-right refers to a direction that is orthogonal, or substantially orthogonal, to the longitudinal direction. The terms up or upward or down or downward refer to the top or bottom of the article, or to a direction substantially toward the top or bottom of the article, respectively. The terms in or inward refer to a direction toward the center of the article, and out or outward refers to the opposite direction away from the center or central portion of the article.

Referring to the figures, and particularly FIGS. 1-15, a lightweight composite roofing support system 10 is disclosed. The lightweight composite roofing support system 10 or wedge is a device that supports a roofing load 2, including a load from the weight of a roofing worker 6 or workers, or a roofing material 8, such as shingles 74, rolled roofing material, structural members (e.g. dimensional lumber), underlayment (e.g. sheets of OSB and/or plywood) and/or fasteners, or loads associated with other items placed thereon, on sloped or pitched roofs 36. In certain embodiments, the lightweight composite roofing support system 10 may also be referred to as a roof step because it provides a platform for a worker to walk, stand, kneel, or sit on. In certain embodiments, the lightweight composite roofing support system 10 may be used without the requirement of fasteners to hold it in place. In these embodiments, the weight of a roofing load 2 placed on the lightweight composite roofing support system 10 together with the coefficient of friction of the surface of the support system in contact with the roof 36 secures the system to the roof. Alternately, in certain embodiments, fasteners 4, such as nails, screws or staples, may also be employed to further secure the lightweight composite roofing support system 10 to a roof deck 37 of a roof 36. The system 10 is a composite because it comprises a core member 12 made from a core material 14 and a cover layer 16 made from a cover material 18.

As illustrated in FIGS. 1-3D, in one embodiment, the lightweight composite roofing support system 10 includes a longitudinally-extending core member 12 having a wedge-shaped lateral cross-section 22, a thin 24 end or edge, a thick end or edge 26, a first side 28, and a second side 30. The core member 12 comprises and is formed from a core material 14. The first side 28 and the second side 30 taper toward one another at the thin edge 24. The first side 28 may also be referred to as the roof contact side 28 and is configured for pressing engagement against the surface of the roof 36. The second side 30 may also be referred to as the first load-bearing side 30 and is configured to receive and support the roofing load 2. In one embodiment, the pressing engagement of the first side 28 is sufficient to secure or attach the lightweight composite roofing support system 10 to the roof 36 and prevent the system and a roofing load 2 (once applied) from sliding down the roof 36 both with and without the use of fasteners 4. At least one of the first side 28 and the second side 30 includes a cover layer 16 comprising a cover material 18. In the embodiment of FIGS. 1-3D, the cover layer 16 is disposed on and covering at least a portion of the longitudinally-extending first side 28. The core member 12 and cover layer 16 comprise a first roofing support 32.

In the embodiment of FIGS. 1-3D, the core member 12 may comprise a longitudinally-extending shell 25 that extends in the direction of axis 9, and a longitudinally-extending base or bottom 27 that is configured to be attached to the shell. The longitudinally-extending base 27 may be attached to the shell 25 by any suitable base attachment 29 or attachment mechanism, including various base fasteners 43, as described herein.

The longitudinally-extending shell 25 may have any suitable configuration and any suitable size, including any suitable length (l) and width (w). In one embodiment, the longitudinally-extending shell 25 has a one-piece shell configuration, which may be produced by molding or forming the core material 14 into the shell. In one embodiment, the size may comprise a length that ranges from 18 to 144 inches, more particularly 24 to 72 inches, even more particularly 24 to 48 inches, and yet more particularly 24-36 inches. In one embodiment, the size may comprise a width that ranges from 18 to 48 inches, more particularly 20 to 40 inches, even more particularly 20 to 30 inches, and yet more particularly 22-28 inches. In one embodiment, the length (l) is greater than the width (w). The longitudinally-extending shell 25 also has a thickness ($t_s$) such that the various portions or sides of the shell 25 comprise walls or sidewalls. The thickness may be substantially constant within the shell 25 and the various walls or sidewalls or may vary either amongst the various walls or sidewalls or within any particular wall or sidewall. In one embodiment, the thickness may encompass a range of 0.10 to 0.50, more particularly 0.125 to 0.375 inches, and even more particularly 0.125 to 0.25 inches.

The longitudinally-extending shell 25 may be formed from any suitable core material 14, including various metals, engineering thermoplastic or thermoset polymers, or composites thereof, including those described elsewhere herein. In one embodiment, the shell 25 comprises high density polyethylene (HDPE). The shell 25 may be molded as an integral or one-piece component to include all of the elements described herein by any suitable molding or forming method, including various conventional molding methods employed to mold engineering thermoplastic or thermoset polymers, including injection molding.

The longitudinally-extending shell 25 includes the second side 30, third side 34, and fourth or additional side 35 that extends between the second side 30 and the third side 34. The molded shell 25 also includes a first end 47 and an opposed second end 49 attached to the first 28, second 30, third 34 and fourth 35 sides, and a flange or lip 45. In one embodiment, the flange or lip 45 comprises a partially-peripherally extending flange or lip 45 because it extends only partially around the periphery of the lowermost portion of at least one of, and in certain embodiments all of, the second side 30, third side 34, fourth or additional side 35, first end 47 and second end 49. In one embodiment, the partially peripherally-extending flange or lip 45 comprises two intersecting legs having an L-shape or substantially L-shape cross-section. In one embodiment, the first leg 55 is attached to and extends substantially horizontally, including horizontally, from the lowermost portions of the second side 30, third side 34, fourth or additional side 35, first end 47 and second end 49. A second leg 57 is attached to the outermost end of the first leg 55 and extends downwardly away from the first leg. The first leg 55 and the second leg 57 may have any suitable size, including length, and may have the same length or different lengths. In one embodiment, the lengths of the first leg 55 and the second leg 57 range, as measured from the outer surface of the shell 25, from 0.25 to 1.0 inches, and more particularly from 0.4 to 0.8 inches. The flange or lip 45 extends outwardly away from lowermost portions of the second side 30, third side 34, fourth or additional side 35, first end 47, and second end 49. The periphery of the flange or lip 45 forms a pocket 61 within the lower surface of the lower portion of longitudinally-extending shell 25 that is configured to receive the longitudinally-extending base 27.

Figure 2:
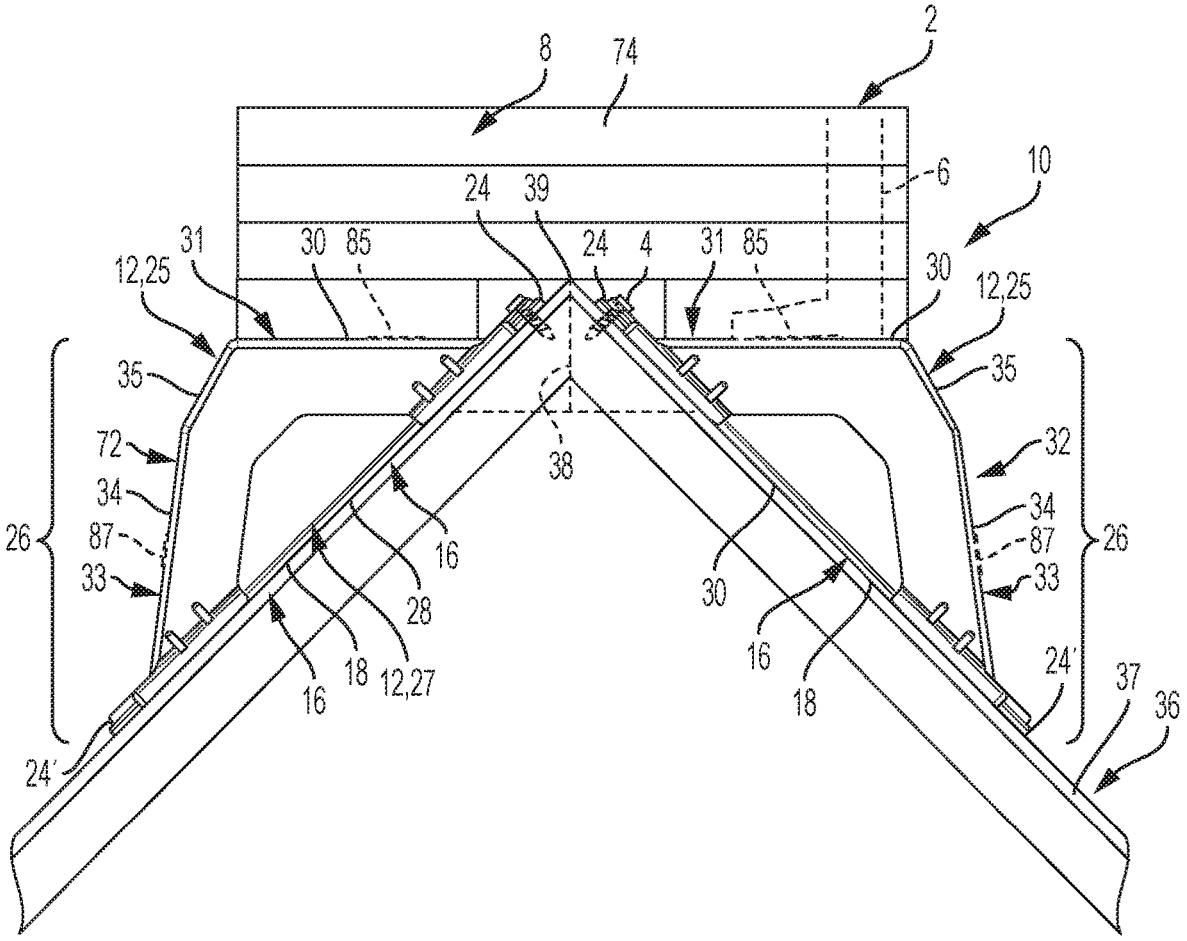
FIG. 2 is a plan view of two of the roofing support systems and roof supports of FIG. 1, which also include an exemplary non-skid surface, disposed on a roof, and thereby illustrating a method of using the systems.

The longitudinally-extending shell 25 also includes a plurality of shell attachment structures 65 configured for attachment of the longitudinally-extending shell 25 and lightweight composite roofing support system 10 to the roof 36 and roof deck 37. The shell attachment structures 65 may comprise any suitable configuration or structure or feature of the longitudinally-extending shell 25 sufficient to attach the shell to the roof 36 and roof deck 37. In one embodiment, the attachment structures 65 comprise a plurality of protruding lugs 71 that protrude from the flange or lip 45. In one embodiment, the plurality of protruding lugs 71 are spaced apart from one another about the periphery of the flange or lip 45 and may be located along any portion of the flange. In one embodiment, a first portion (e.g. four lugs) of the plurality of protruding lugs 71 are spaced apart along the portion of the flange or lip 45 proximate to the second side 30 and a second portion (e.g. four lugs) of the plurality of protruding lugs 71 are spaced apart along the portion of the flange or lip 45 proximate to the third side 34. The protruding lugs 71 may have any suitable shape or size, including a generally rectangular or rounded rectangular projection from the flange or lip 45. The protruding lugs 71 include an opening 73, which in one embodiment is an integrally molded keyhole-shaped opening 73 comprising a bore and radially extending slot that extends through the lugs from a top surface to a bottom surface of the of the shell 25. The keyhole-shaped opening 73 is configured to receive a fastener 4 that is configured to selectively attach (and/or detach) the longitudinally-extending shell 25 and the lightweight composite roofing support system 10 to the roof 36 and roof deck 37. In one embodiment, the lightweight composite roofing support system 10 is attached to a roof deck 37 using fasteners attached through the openings 73 in the lugs 71 on the up-roof (i.e. closest to the peak) side of the shell 25, as shown in FIG. 2.

In one embodiment, the longitudinally-extending shell 25 also includes a plurality of internal ribs 75, including spaced apart, integrally formed internal ribs 75 that extend downwardly from the second side 30, fourth side 35, and the third side 34 and also extend laterally from the second side 30 across the fourth side 35 to the third side 34. The plurality of internal ribs 75 are configured to strengthen and stiffen the longitudinally-extending shell 25 and are spaced apart along longitudinal axis 9. The plurality of internal ribs 75 may comprise any suitable number of ribs, including 6 to 12 ribs. The internal ribs 75 may have any suitable shape or size, including the shape shown in FIG. 3D comprising inwardly, upwardly-extending legs joined to a horizontally-extending central portion. The internal ribs 75 may have any suitable thickness ($t_R$), including a thickness of 0.10 to 0.50 inches, more particularly 0.125 to 0.375 inches.

In one embodiment, the longitudinally-extending shell 25 also includes a plurality of spaced apart, external ribs 77 that extend between the first end 47 and the flange or lip 45 (e.g. 4 ribs) and the second end 49 and the flange or lip 45 (e.g. 4 ribs), more particularly between the lower portion of the first end 47 and the top surface of flange or lip 45 and the lower portion of the second end 49 and the top surface of flange or lip 45. The plurality of spaced apart, external ribs 77 may have any suitable shape or size, including the shapes and sizes shown in FIGS. 1-3C.

The longitudinally-extending shell 25 may be molded by any suitable molding or forming method, including various conventional molding methods employed to mold engineering thermoplastic or thermoset polymers, including injection molding.

Figure 3A:
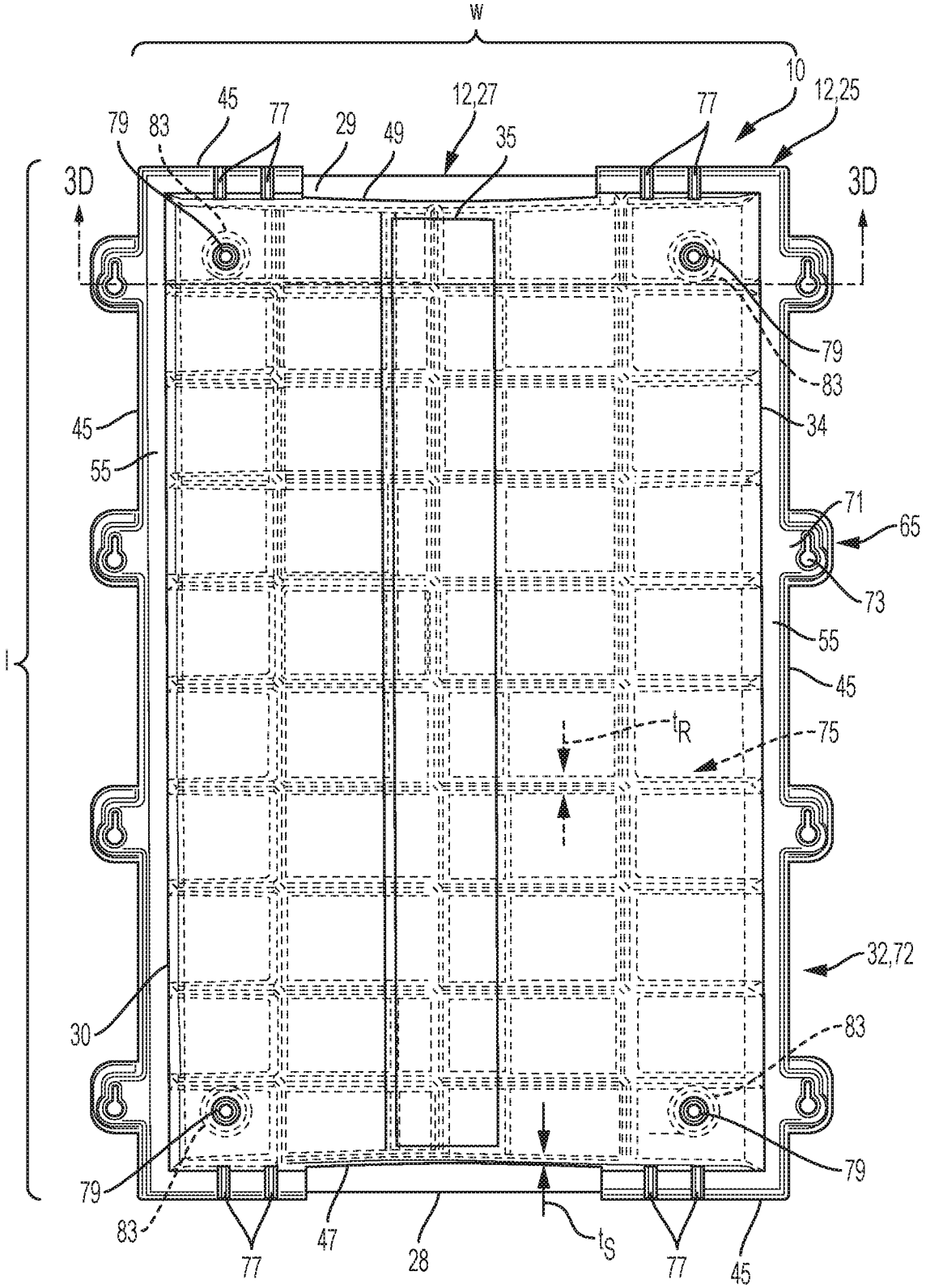
FIG. 3A is a top view of the roofing support system and roof support of FIG. 1.
Figure 3B:
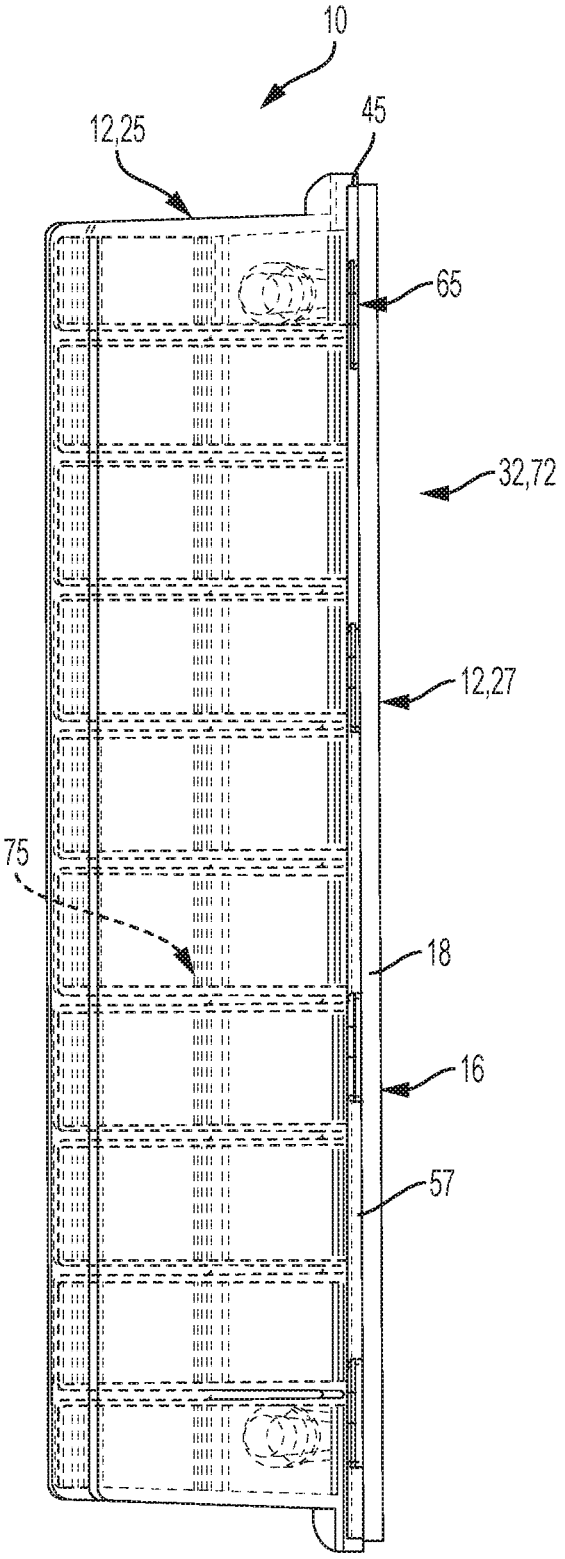
FIG. 3B is a right side view of the roofing support system and roof support of FIG. 3A.
Figure 3D:
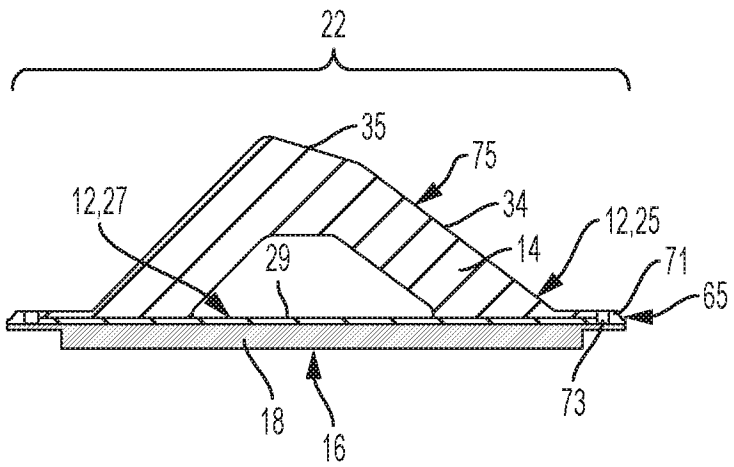
FIG. 3C is a front side view of the roofing support system and roof support of FIG. 3A.
FIG. 3E is a partial cross-sectional view of an alternate embodiment of the boss of FIG. 3A.
Figure 3E:
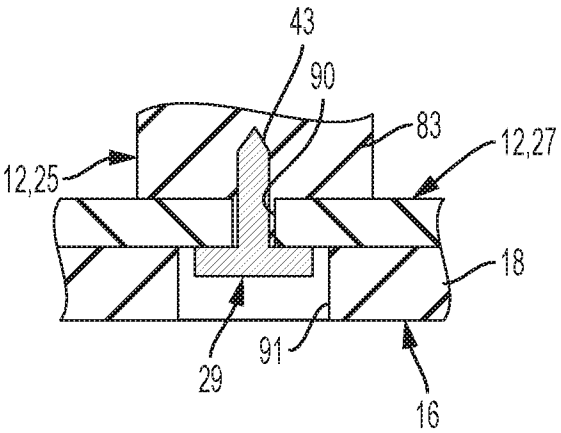
Figure 3C:
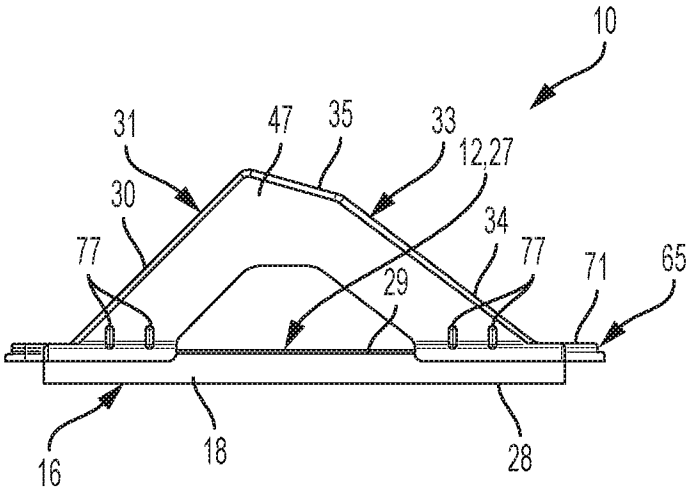

The longitudinally-extending base 27 may have any suitable configuration. In one embodiment, the longitudinally-extending base 27 comprises a one-piece molded or formed sheet. In other embodiments (not shown), the longitudinally-extending base 27 may comprise a plurality of sheets placed proximate to one another. In one embodiment, the longitudinally-extending base 27 is configured to be disposed within the pocket 61 and attached to the longitudinally-extending shell 25. In the embodiment of FIGS. 1-3D, the flange or lip 45 and the longitudinally-extending base 27 comprise the second side 30. The cover layer 16 is disposed on, attached to, and covering the longitudinally-extending base 27 portion of the second side 30. The longitudinally-extending base 27 is in pressing contact against the lower surface of the lower portion of longitudinally-extending shell 25, such as, for example, the lower surface of first leg 55, and is fixed in place by a base attachment 29, or a plurality of attachments, such as a plurality of base fasteners 43, which may include any suitable screws or threaded bolts and nuts. The base fasteners 43 are inserted into and through the plurality of bores 79 and attached to the longitudinally-extending base 27. The bores 79 may be formed in internal fastener bosses 83 formed on the underside of the shell 25 to strengthen and/or stiffen the shell for the purpose of bearing the loads associated with the base fasteners. Alternately, in one embodiment as illustrated in FIG. 3E, base attachment 29 may include bosses 83 as described and the longitudinally-extending base 27 may be attached from the lower side using a plurality of base fasteners 43, and the base 26 and cover layer 16 may include respective bores 90, 91 configured to receive the fasteners. The use of a plurality of base fasteners 43 comprises a selectively attachable and detachable base attachment 29. Base attachment 29 may also alternately include various two-sided adhesive tapes or hook and loop materials attached to and disposed between the longitudinally-extending base 27 and the longitudinally-extending shell 25, which also provide selectively attachable and detachable base attachments 29. Alternately, the attachment may be a permanent attachment (not shown), such as a glue joint or glue joints or a weld or a plurality of weld that fix the longitudinally-extending base 27 to the longitudinally-extending shell 25. The longitudinally-extending base 27 may have any suitable size and shape. In one embodiment it has a shape and size that provides a slight interference fit within the periphery of the pocket 61, and in other embodiments a shape and size that just avoids an interference fit and provides a small gap or tolerance (e.g. 0.005 to 0.050 inches) between the peripheral edges of the base 27 and the inner surface of the leg 57 of flange or lip 45 within the pocket 61. The base 27 may have any suitable thickness, which in one embodiment may range from 0.10 to 0.50, more particularly 0.125 to 0.375 inches, and even more particularly 0.125 to 0.25 inches. The longitudinally-extending base 27 may be formed from any suitable material, including various metals, engineering thermoplastic or thermoset polymers, or composites thereof, as described herein. In one embodiment, the base 27 comprises high density polyethylene (HDPE). In another embodiment, the base comprises a metal, including various permanent magnet alloys and ferromagnetic materials that can be used to form an electromagnet by application of an electric current.

The cover layer 16 may include any suitable cover material 18, including those described herein, and may have any suitable shape and size, including in the embodiment of FIGS. 1-3D, substantially the same or the same shape and size as the longitudinally-extending base 27, and in other embodiments (not shown) a different size and shape. The cover layer 16 may include any of the features or coatings as described herein. The cover layer 16 may have any suitable thickness as described herein. The cover layer 16 and cover material 18 may be attached to the base 27 and core 12 as described herein.

In one embodiment, the longitudinally-extending shell 25 may be configured to receive a plurality of longitudinally-extending bases 27, each base comprising a different cover layer 16 and cover layer material 18. In one embodiment, the longitudinally-extending shell 25 may be configured to receive a plurality of longitudinally-extending bases 27, each base comprising a different cover layer 16 and cover layer material 18, and the plurality of longitudinally-extending bases 27 with different cover layers 16 and cover materials 18 may be provided as a kit to configure the lightweight composite roofing support system 10 for use on a plurality of different roof 36 types, including different roof decks comprising different deck materials, such as wood (e.g. OSB, plywood, or cedar shakes), various asphalt and plastic rolled roofing materials, asphalt shingles, plastic/composite/ceramic shingles or tiles, metal sheets, and other conventional roofing materials.

The lightweight composite roofing support system 10 comprising first roofing support 32 has a wedge shape formed by longitudinally-extending first side 28 and second side 30 that are joined to and intersect one another and are separated by a predetermined acute angle (α). The first roofing support 32 may have any number of additional longitudinally-extending sides such that the lateral cross-sectional shape is polygonal with the polygon shape commensurate with the number of longitudinally-extending sides selected, including in the embodiment of FIGS. 1-3D, a third side 34 and a fourth or additional side 35 that extends between the first side and the third side. In other embodiments, the additional side 35 may comprises a plurality of additional sides 35, 35', etc. In the embodiment of FIGS. 1-3D, the lateral cross-sectional shape may also be described as a generally triangular or a truncated triangular shape because the first side 28, second side 30 and third side 34 are much longer than the fourth side 28. The second side 30 and third side 34 are joined to and intersect one another and are separated by a predetermined acute angle (β) that is different than angle (α).

In this embodiment, in a first configuration or orientation where the thin edge 24 at the intersection of first side 28 and second side 30 and defining predetermined acute angle (α) is placed facing up-roof closest to the peak 39 or apex of the roof 36 with first side 28 in pressing contact against the roof, and substantially parallel or parallel to the peak, the angle (α) may be selected to be the same as the first predetermined angle or pitch (e.g. 12/12 pitch) of the roof 36 so that the second side 30 extends in the direction of the peak 39 as a substantially horizontal or horizontal platform, which advantageously provides a very useful substantially level or level first working surface 31 on the roof for use as described herein. As used here, substantially parallel includes minor misorientations of the thin edge 24 with the line defined by the peak 39 such that they are non-parallel, and second side 30 is not level, but rather substantially level although it may be slightly inclining or declining as compared to the peak 39 of the roof 36. One of ordinary skill in the roofing arts will understand that substantially parallel orientations still provide a very useful first working surface 31 of second side 30 as compared to the alternative of using the steeply pitched roof 36 as the working surface. One of ordinary skill in the roofing arts will also understand that the orientation with the thin edge 24 at the intersection of first side 28 and second side 30 and defining angle (α) is placed facing up-roof closest to the peak 39, and substantially parallel or parallel to the peak, that the lightweight composite roofing support system 10 also provides a useful first working surface 31 for roofs 36 with a range of similar roof pitches that are greater than and less than the first predetermined roof pitch 38 that is the same as angle (α) (e.g. a 12/12 pitch), such as, for example, a range of 15/12 to 9/12 (excluding 12/12), or more particularly 14/12 to 10/12 (excluding 12/12), even though the first working surface 31 of second side 30 is not substantially horizontal (or horizontal) or level on these roofs. This is because the slight inward or outward slope of the first working surface 31 of second side 30 for these roof pitches is still much preferred compared to using the surfaces of these steeply pitched roofs 36 as the working surface to support roofing loads 2. In one embodiment, the first working surface 31 comprises a first non-skid surface 85 over all, or a portion or portions of, the first working surface. In one embodiment, the first non-skid surface 85 comprises a first predetermined surface texture or surface roughness, or a predetermined pattern, such as an embossed pattern. The first non-skid surface 85 may be formed by adding a material or materials to the first working surface 31 or may be integrally formed in the core material of the first working surface by molding the same into the surface. In one embodiment, the first working surface 31 includes a cover layer 16 of a cover material 18 disposed on the shell 25 and the cover layer comprises the first non-skid surface 85. In the embodiment of FIGS. 1-3D, the third side 34 and fourth or additional side 35 define the thick edge 26 and may also be referred to as the support sides 34 and 35 as they bear much of the vertical component of the roofing load 2.

This embodiment of lightweight composite roofing support system 10 is also configured for an alternate use in a second configuration or orientation on another roof or roofs 36 having a second predetermined roof pitch 42 or range of pitches that is different from the first predetermined roof pitch 38 or range of pitches. Alternately, in this embodiment, as will easily be understood by one of ordinary skill both from FIGS. 1-3D, as well as the other embodiments of FIGS. 4-13 (particularly FIGS. 4 and 4A), the second orientation of lightweight composite roofing support system 10 may be changed by 180° from the first orientation so that predetermined acute angle (β) is placed facing up-roof closest to the peak 39 or apex of another or second steeply pitched roof or roofs 36 having a second predetermined roof pitch 42 that is different than the first predetermined roof pitch 38. In the second orientation, the thin edge 24' is defined by the intersection of the third side 34 and the first side 28 and is configured for placement substantially parallel or parallel to the roof peak 39 with the first side 28 in pressing contact with the roof. The angle (β) may be selected to be the same as the second predetermined roof pitch 42 (e.g. a 10/12 pitch) of the second roof 36 so that the third side 34 extends in the direction of the peak 39 as a substantially horizontal or horizontal platform, which advantageously provides a very useful substantially level or level second working surface 33 on the second roof for use as described herein. As used herein, substantially parallel includes minor misorientations of the thin edge 24' formed by third side 34 and first side 28 with the line defined by the peak 39 such that they are non-parallel, and third side 34 is not level, but rather substantially level although it may be slightly inclining or declining as compared to the peak 39 of the roof 36. One of ordinary skill in the roofing arts will understand that substantially parallel orientations still provide a very useful second working surface 33 of third side 34 as compared to the alternative of using the steeply pitched roof 36 as the working surface. One of ordinary skill in the roofing arts will also understand that the orientation with the thin edge 24' at the intersection of third side 34 and first side 28 and defining angle (β) is placed facing up-roof closest to the peak 39, and substantially parallel or parallel to the peak, that the lightweight composite roofing support system 10 also provides a useful second working surface 33 (e.g. third side 34) for roofs 36 with a range of similar roof pitches that are greater than and less than the second predetermined roof pitch that is the same as angle (β) (e.g. 10/12 pitch), such as, for example, a range of 13/12 to 7/12 (excluding 10/12), or more particularly 12/12 to 8/12 (excluding 10/12), even though the second working surface 33 of third side 34 is not substantially horizontal (or horizontal) or level on these roofs. This is because the slight inward or outward slope of the second working surface 33 of the third side 34 for these roof pitches is still much preferred compared to trying to use the surfaces of these steeply pitched roofs 36 as the working surface to support roof loads 2. In one embodiment, the second working surface 33 comprises a second non-skid surface 87 over all, or a portion or portions of, the second working surface. In one embodiment, the second non-skid surface 87 comprises a first predetermined surface texture or surface roughness, or a predetermined pattern, such as an embossed pattern. The second non-skid surface 87 may be formed by adding a material or materials to the second working surface 33 or may be integrally formed in the core material of the second working surface by molding the same into the surface. In one embodiment, the second working surface 33 includes a cover layer 16 of a cover material 18 disposed on the shell 25 and the cover layer comprises the second non-skid surface 87. The first non-skid surface 85 and the second non-skid surface 87 may be the same non-skid surfaces (e.g., texture, roughness, or pattern), or different non-skid surfaces. In the embodiment of FIGS. 1-3D, the second side 30 and fourth or additional side 35 may also be referred to as the support sides 30 and 35 as they bear much of the vertical component of the roofing load 2.

As illustrated in FIG. 2, in one embodiment, a first roofing support 32 and lightweight composite roofing support system 10 as described above that includes the shell 25 and base 27 as the core member 12 and cover layer 16 may secured to a roof 36 proximate the peak 39. An opposed second roofing support 72 and lightweight composite roofing support system 10 as described above that includes the shell 25 and base 27 as the core member 12 and cover layer 16 may also be secured to the roof 36 proximate the peak 39. The first roofing support 32 and the second roofing support 72 may have the same shape and size, or alternately, they may comprise different shapes and sizes. In one embodiment, the first roofing support 32 and the second roofing support 72 may have the same shape and size and be disposed on the roof in an opposed relationship as shown in FIG. 2, including in a mirror image relationship where they are spaced equidistant from the peak 39. The first roofing support 32 and the second roofing support 72 comprise a secure over-peak 39 platform that may be used to support a roofing load 2, particularly a load comprising roofing materials 8, such as bundles of shingles 74. This configuration is very advantageous on steeply pitched roofs because the staging of roofing material 8, particularly shingles 74, on steeply pitched roofs 36 is a very well-known problem on buildings that include such roofs.

Figure 4A:
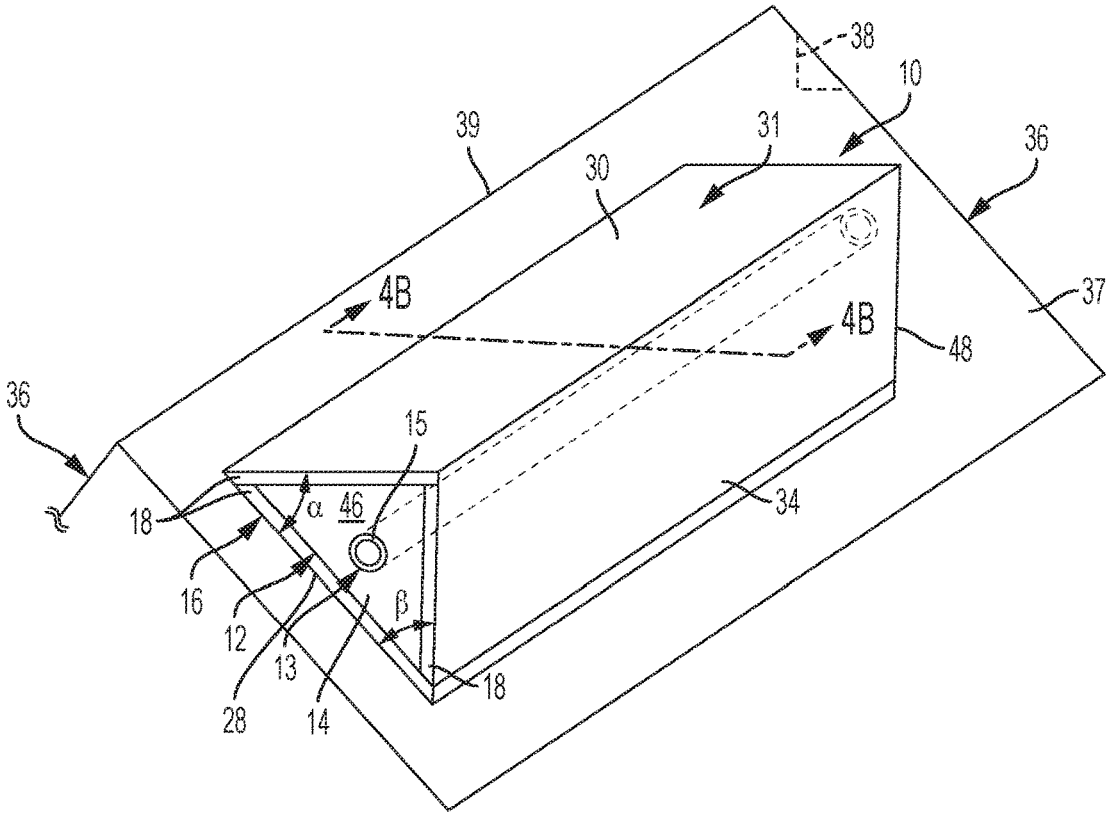
FIG. 4A is a perspective view of a second embodiment of a roofing support system and roof support as disclosed herein.
Figure 4B:
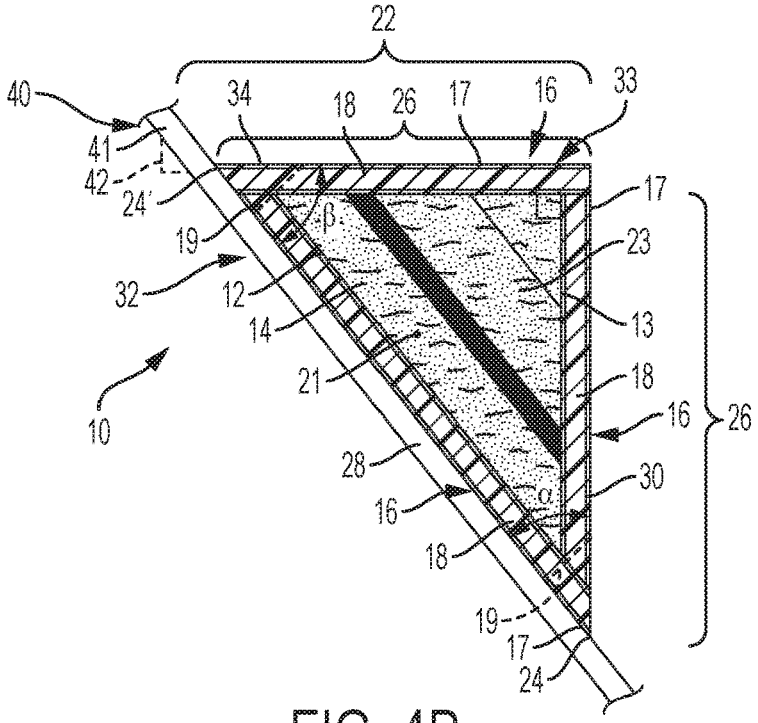
FIG. 4B is a cross-sectional view along Section B-B of FIG. 4A.
Figure 5:
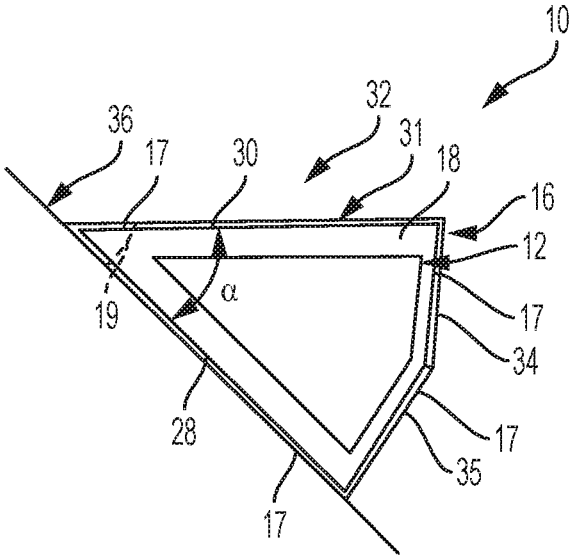
FIG. 5 is an end plan view of a third embodiment of a roofing support system and roof support as disclosed herein.
Figure 6:
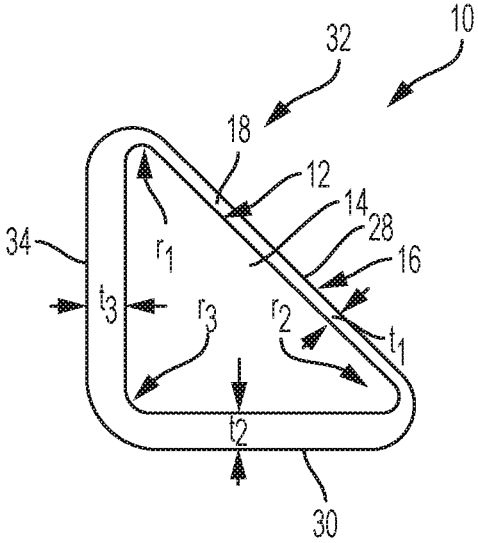
FIG. 6 is an end plan view of a fourth embodiment of a roofing support system and roof support as disclosed herein.
Figure 7:
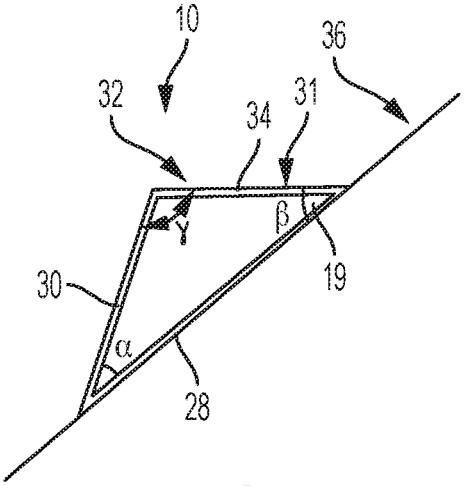
FIG. 7 is an end plan view of a fifth embodiment of a roofing support system and roof support as disclosed herein.
Figure 8A:
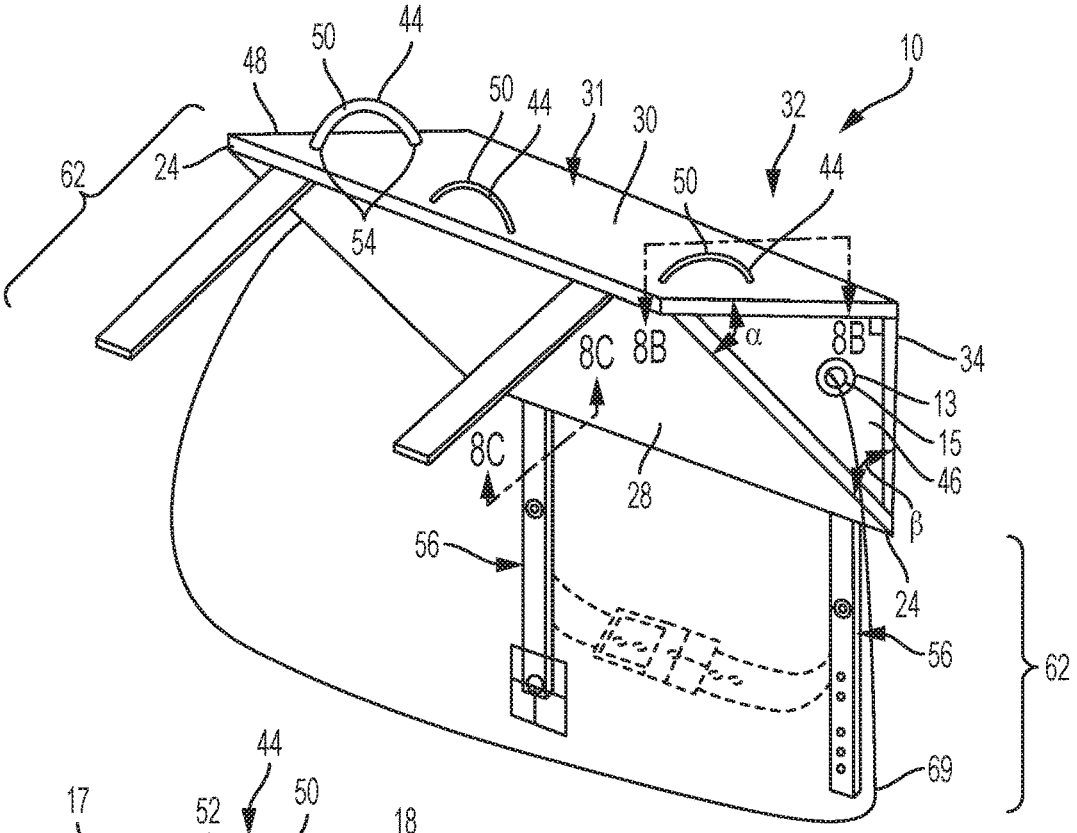
FIG. 8A is a perspective view of a sixth embodiment of a roofing support system and roof support as disclosed herein.
Figure 8B:
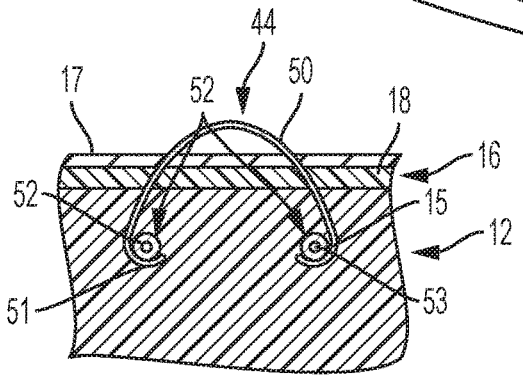
FIG. 8B is a cross-sectional view along Section 8B-8B of FIG. 8A illustrating an embodiment of a handle and strap handle as disclosed herein.
Figure 8C:
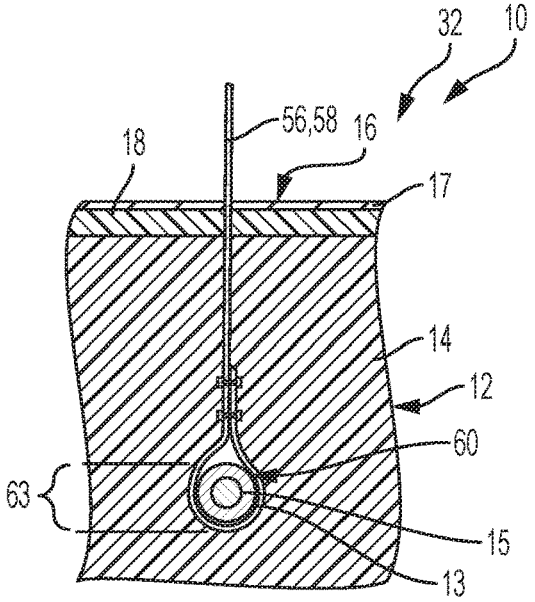
FIG. 8C is a cross-sectional view along Section 8C-8C of FIG. 8A illustrating an embodiment of strap as disclosed herein.
Figure 9A:
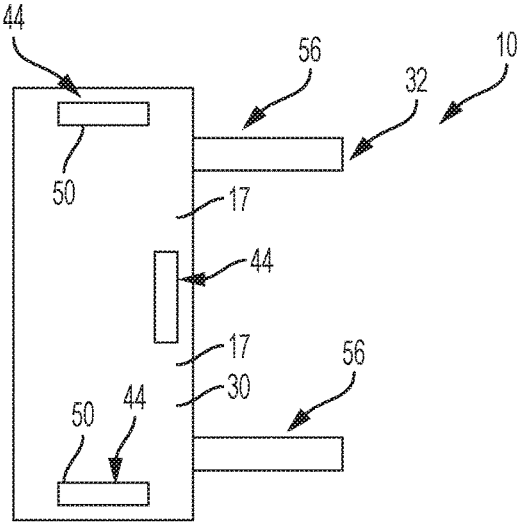
FIG. 9A is a top plan view of the embodiment of FIG. 8A.
Figure 9B:
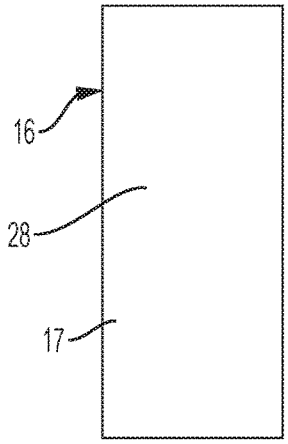
FIG. 9B is a bottom plan view of the embodiment of FIG. 8A.
Figure 9C:
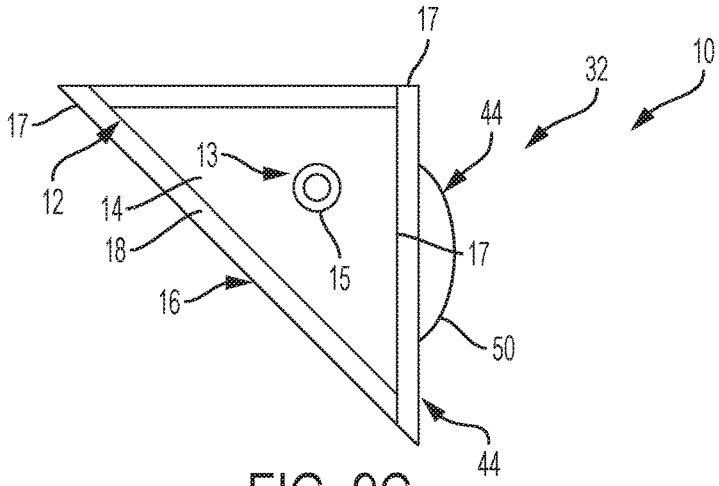
FIG. 9C is an end plan view of the embodiment of FIG. 8A.
Figure 9D:
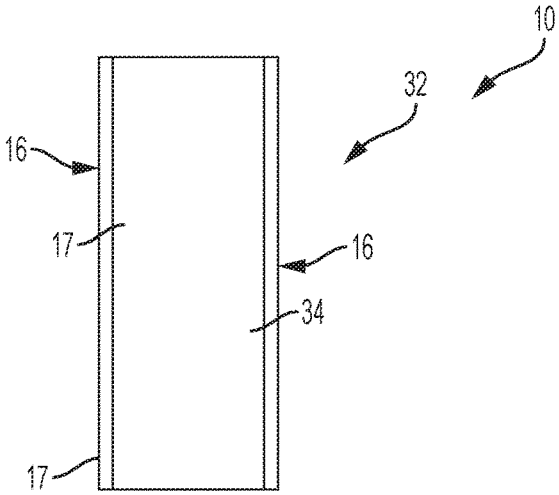
FIG. 9D is a rear plan view of the embodiment of FIG. 8A.

As illustrated in FIGS. 4-7, in certain embodiments, the lightweight composite roofing support system 10 includes a longitudinally-extending core member 12 having a wedge-shaped lateral cross-section 22, a thin 24 edge, a thick edge 26, a first side 28, and a second side 30. The first side 28 and the second side 30 tapering toward one another at the thin edge 24. The core member 12 comprises and is formed from a core material 14. The core member 12 may be coated with a coating layer 13 on the outer surface to make the core member more durable. The cover layer 16 comprises a cover material 18. The cover layer is disposed on and covering the longitudinally-extending first side 28 and longitudinally-extending second side 30. The cover material 18 is substantially more compressible than the core material 14. The core material 14, for example, having the compressive stress/strain characteristics of commercially available polystyrene or polyurethane sheets or blocks in various densities or weights (e.g. 1 pound, 2 pound, 4 pound, etc.), wherein the core material exhibits a combination of elastic and ultimately plastic deformation or fracture. The cover material 18, for example, having the compressive stress-strength characteristics of commercially available polystyrene or polyurethane elastomer sheets in various densities or weights, wherein the material exhibits essentially entirely elastic deformation under typical roofing loads. In one embodiment, the core member 12 and core material 14 and/or the cover layer 16 and cover material 18 themselves comprise a composite material, such that they may comprises internal layers or regions comprising a plurality of different materials, or the same material with a gradient of any desired material property such as density and/or stress/strain response characteristics. For example, the outer surface of the cover layer 16 may have a coating layer 17 or skin to promote an increased coefficient of sliding friction over one or more of an asphalt or fiberglass shingle, a roofing underlayment material (e.g. cloth or asphalt), or a wood or engineered wood surface and thereby provide a non-skid outer surface. In another embodiment, the cover material 18 may simply be selected to provide a non-skid outer surface without the necessity of a separate coating layer or skin. The core member 12 and cover layer 16 together form or comprise a first roofing support 32. While the first roofing support 32 has a wedge shape formed by longitudinally-extending first side 28 and second side 30, the first roofing support 32 may have any number of additional longitudinally-extending sides, including in one embodiment a third side 34 such that the lateral cross-sectional shape is generally triangular (FIGS. 4A and 4B), or in other embodiments a plurality of additional sides such that the lateral cross-sectional shape is generally polygonal with the polygon shape commensurate with the number of longitudinally-extending sides selected (FIG. 5). In embodiments that include third side 34 or a plurality of additional sides 35, 35', etc., the cover layer 16 and skin 17 may also be disposed on the third side 34 or additional sides 35, 35', etc.

As illustrated in FIG. 4A in one embodiment, the roofing support system 10 and first roofing support 32 comprises a third side 34, and the wedge-shaped lateral cross-section comprises a generally or substantially triangular-shaped cross-section, including a generally or substantially right triangular-shaped cross-section, with the third side opposite a first predetermined angle (α) formed by the convergence, including the intersection, of the first side 28 and the second side 30. In this context, generally or substantially triangular includes embodiments where one or more of the vertices of the triangle are truncated (as illustrated by phantom line 19 in FIG. 4B) proximate the point where the vertex would have occurred such that the converging sides do not actually intersect to form the vertex, or shapes that include one or more radii (e.g. $r_1$, $r_2$, $r_3$ in FIG. 7) in place of the vertices (i.e. a rounded triangular shape), but where one of ordinary skill would readily recognize a generally or substantially triangular shaped cross-sectional form. In another embodiment, the first side 28 and second side 30 taper toward one another at a first predetermined acute angle (α) and the first side 28 and the third side 34 taper toward one another at a second predetermined acute angle (β) that is different than the first predetermined acute angle (α). In one embodiment, as shown in FIG. 4A-4B, the roofing support system 10 has a right triangular cross-sectional shape and the first predetermined acute angle (α) is selected so that when the first side 28 is placed with the first predetermined acute angle (α) converging upslope against a first roof 36 having a first pitch 38 the second surface 30 is substantially horizontal and the second predetermined acute angle (β) is selected so that, in another embodiment of roof, when the first side 28 is placed with the second predetermined acute angle (β) converging upslope against a second roof 40 and roof deck 41 having a second pitch 42 the third side 34 is substantially horizontal, and wherein the first pitch 38 and the second pitch 42 are different, and wherein one of a convergence of the first side and second side or a convergence of the first side and the third side comprises the thin edge 24 of the wedge. As used herein substantially horizontal includes horizontal, as well as small angular deviations from horizontal either toward or away from the roof, when the device is placed parallel to the peak 39 on a roof having the respective first pitch or second pitch for which the device has been designed. In this context, small angular deviations may include 0.05 to 5 degrees, and more particularly 0.05 to 2 degrees. In addition to right triangular cross-sectional configurations, various scalene triangular cross-sectional configurations (FIG. 7) of roofing support 32, including those where the angle (γ) is greater than 90°, may also be used to provide useful configurations for one, two, or three different roof pitches where when the device is placed parallel to the peak 39 on a roof 36 the upward facing surface is horizontal or substantially horizontal.

In one embodiment, the core material 14 of core member 12 is substantially non-compressible as described herein (i.e. experiences only a minor amount of elastic deformation) under a predetermined roofing load (l) and the cover material 18 is substantially compressible under the predetermined roofing load (i.e. experiences a greater amount of elastic deformation than the core material, generally significantly greater). For example, in one embodiment, substantially non-compressible core material includes less than 10% elastic deformation under the predetermined roofing load, more particularly less than 5% deformation, and even more particularly less than 1% deformation, and includes ranges of 1-10% deformation, more particularly 1-5% deformation, and even more particularly 1-3% deformation; and substantially compressible includes greater than or equal to 0% elastic deformation under the predetermined roofing load, more particularly more than 20% deformation, and even more particularly more than 50% deformation, and includes ranges of 10-70% deformation, more particularly 20-50% deformation, and even more particularly 20-50% deformation. In this embodiment, the predetermined roofing load may include the weight of at least one person, which in one embodiment ranges from 100 to 350 lbs., or the weight of at least one bundle of shingles, which in one embodiment ranges from 40-80 lbs., or the weight of at least one roll of underlayment, which in one embodiment ranges from 16-100 lbs., or a combination thereof. In other embodiments, the predetermined roofing load may include a plurality of the above items.

In one embodiment, the core material 14 comprises a substantially non-compressible or rigid engineering thermoset or thermoplastic polymer including reinforced polymers that include various fillers 21 or fiber 23 reinforcements and the cover material 18 comprises a substantially and reversibly compressible thermoset or thermoplastic elastomer. In one embodiment, at least one of the core material 14 and the cover material 18 comprises polystyrene or polyurethane. For example, in one embodiment the core material 14 comprises molded, solid, substantially non-compressible polystyrene, including expanded polystyrene, or polyurethane, in one or more commercially available densities, such as commercially available 1 lb., 2 lb. or greater polystyrene, and the cover material 18 comprises a compressible open or closed cell polystyrene, polyurethane, or latex foam, including various viscoelastic, low-resilience, or memory foams, particularly polyurethane foams. Cover layer 16 and cover material 18 may be attached to the outer surface, including any coating 13, of core member 12 by any suitable means of attachment, including a permanent glue joint, or by fasteners providing a selectively removable joint extending between the cover layer 16 and core member 12, including fasteners such as a hook and loop fasteners (e.g. Velcro®) where one layer of the hook or loop is attached to one of the cover layer or member and the respective other layer of the hook or the loop is attached to the other of the layer or member. The cover layer 16 and cover material 18 may also be molded directly onto the core member 12.

The core member 12 may include a longitudinally-extending reinforcement 13, which may extend along the entire length of the core member from end 46 to end 48 where the reinforcement may be exposed, or alternately may extend along only a portion of the length and extend entirely internally within the core member. For example, the reinforcement 13 may be place into a mold and integrally molded into core member 12. Any suitable reinforcement 13 may be employed. Examples include a rod, bar, hollow tube or pipe, fiber or fibers, sheet, web, perforated web, fabric, strap, or any member or structure that provides structural continuity, strength, stiffness, and/or rigidity to the core member 12 along its length. Reinforcement may be solid or hollow or hollow perforated and may have and suitable cross-sectional shape (e.g. round, square, rectangular, I-beam and the like). The reinforcement 13 may formed from any suitable reinforcement material 15, including various metals, engineering polymers including reinforced polymers (e.g. comprising polyvinyl chloride (PVC), polyester (PR), or polyamide (PA)), composite materials (e.g. fiberglass or carbon), rubbers including natural and synthetic rubbers, wood, or natural or synthetic fabric.

The roofing support 32 may have any suitable size, including any suitable length and any suitable width of the sides. In one embodiment, wherein the roofing support 32 has a substantially right triangular cross-section shape, the core member 12 may have a first side 28 having a width of 15 to 26 inches, a second side having a width of 12 to 18 inches, and a third side having a width of 10 to 18 inches. In one embodiment, the roofing support 32 and core member 12 has a length of 30-72 inches, and more particularly 30 to 60 inches, and even more particularly 32 to 48 inches. The cover layer 16 may have any suitable thickness. In one embodiment, the cover layer 16 has a thickness of at least 0.25 inches, and more particularly 0.25 to 2.5 inches, and even more particularly 0.5 to 1.5 inches.

As shown in FIGS. 8A-9D, in one embodiment the composite roofing support system 10 and first roofing support 32 further includes at least one attached handle 44 that is disposed on one or more of the longitudinally extending sides 28, 30, 34 configured to lift the roofing support system 10, proximate or on one or both of opposing ends 46, 48. The handle 44 may be formed from any suitable material, including various metals, polymers including reinforced polymers, composite materials, rubbers including natural and synthetic rubbers, or fabric and may be attached to the composite roofing support system 10 by any suitable fastener 51(e.g. nail, screw, staple, rivet) or attachment mechanism 53 (e.g. loop). In one embodiment, the handle comprises a handle strap 50 of a high strength fabric, such as nylon, including ballistic nylon. The handle strap 50 may include a handle anchor 52 at one end and be embedded in the composite roofing support system 10 in the locations described with a loop 54 in the handle strap 50 forming the handle 44, and in one embodiment may be inserted into a mold for the core member 12 and molded with the handle anchor 52 or anchors embedded within the core member 12 and the portion of the handle strap 50 forming the loop 54 protruding from the member. Handle anchor 52 may have any suitable configuration to anchor the handle 44, such as handle strap 50, within the core member 12 so as to resist or prevent the strap from pulling out of the member in response to application of a tensile force (e.g. lifting). This may include all manner of longitudinally-extending or laterally-extending elements attached proximate the embedded end of the handle strap 50, including short portions (e.g. 1 to 6 inches long, more particularly 1-3 inches long) of the reinforcement 13 elements described below in conjunction with to the strap 56, for example.

As shown in FIGS. 8A-10, in one embodiment the composite roofing support system 10 further includes at least one flexible strap 56 or flexible sheet 58 or mat protruding outwardly away from the thin edge 24, and in certain embodiments may also include a plurality of flexible straps 56 or flexible sheet 58, such as, for example two straps or sheets. Flexible straps 56 may be formed from any suitable flexible material, including various metals, polymers including reinforced polymers, composite materials, rubbers including natural and synthetic rubbers, or fabric and may be attached to the composite roofing support system 10 by any suitable fastener or attachment mechanism. In one embodiment, the strap 56 or straps comprises a high strength fabric, such as nylon, including ballistic nylon. The strap 56 may include a strap anchor 60 at one end and be embedded in the composite roofing support system 10 in the locations described, and in one embodiment may be inserted into a mold for the core member 12 and molded with the strap anchor 60 or anchors embedded within the core member 12 with a portion of the strap 56 protruding and extending outwardly away from the member. The strap 56 or straps may be any suitable overall length and will define a portion 62 that extends or protrudes from the member. The portion 62 may have any suitable length, including 0.5 to 30 feet, and more particularly 1 to 15 feet, and even more particularly 1 to 6 feet, and yet more particularly 1 to 3 feet, and may have any suitable width or thickness, including widths of 0.5 to 4 inches, more particularly 1 to 2 inches, and thicknesses of 0.05 to 0.35 inches, more particularly 0.10 to 0.25 inches. In embodiments that include the reinforcement 13, the strap 56 may be attached to, or engaged around, through, or over the reinforcement, such that the reinforcement provides the strap anchor 60. For example, the strap 56 may be fixedly attached to the reinforcement 13 with a suitable fastener (i.e. the same fasteners 51 used to attach handle strap, or the strap may include a loop 63 on the embedded end and the reinforcement 13 may be disposed within the loop to provide the strap anchor. In other embodiments that may or may not include reinforcement 13, a separate strap anchor 60 may be employed as described above in conjunction with handle strap 50. Strap anchor 60 may have any suitable configuration to anchor the strap 56 within the core member 12 so as to resist or prevent the strap from pulling out of the member in response to application of a tensile force (e.g. lifting or loading of the wedge with the roofing elements described herein). This may include all manner of longitudinally-extending or laterally-extending elements attached proximate the embedded end of the strap 56, including short portions (e.g. 1 to 6 inches long, more particularly 1-3 inches long) of the reinforcement 13 elements described above, for example. In one embodiment, roofing support 32 may be used on a free-standing basis without being fixed to the roof 36. In other embodiments, roofing support 32 may be used by fixing it to the roof 36. Roofing support 32 may be fixed to the roof 36 with any suitable fastener or attachment mechanism, including a nail, screw, or staple, or a combination thereof, by attaching the same directly through the strap or an opening in the strap. Further, each strap 56 may also include one or more metal grommets 67. Metal grommets 67 may be used for any suitable purpose, including as a location for attaching the roofing support to the roof 36 using the fasteners or attachment mechanisms described, wherein the grommet 67 provides a strap reinforcement to prevent the strap from shearing or tearing under load, for example. In embodiments in which the roofing support 32 is fixed to the roof 36 and that include a hollow reinforcement 13, such as a tube or pipe, the reinforcement 13 may be used as a conduit to pass a strap or rope 69 through. The strap or rope 69 may be formed to provide a continuous loop or have free ends joined to form a loop, and the loop may be used to extend on the downslope of the roof away from the support and act as an additional safety device. For example, in the event of a slip, trip, stumble, or other event knocking the worker off from the support, a roofing worker can grab onto the strap or rope 69 to prevent tumbling or sliding off of the roof. This is very advantageous because it is well-known in the roofing arts that it is very difficult to prevent falling off of a steeply pitched roof (e.g. 8/12 slope or greater) in the circumstances described once an accidental loss of balance occurs.

Figure 10:
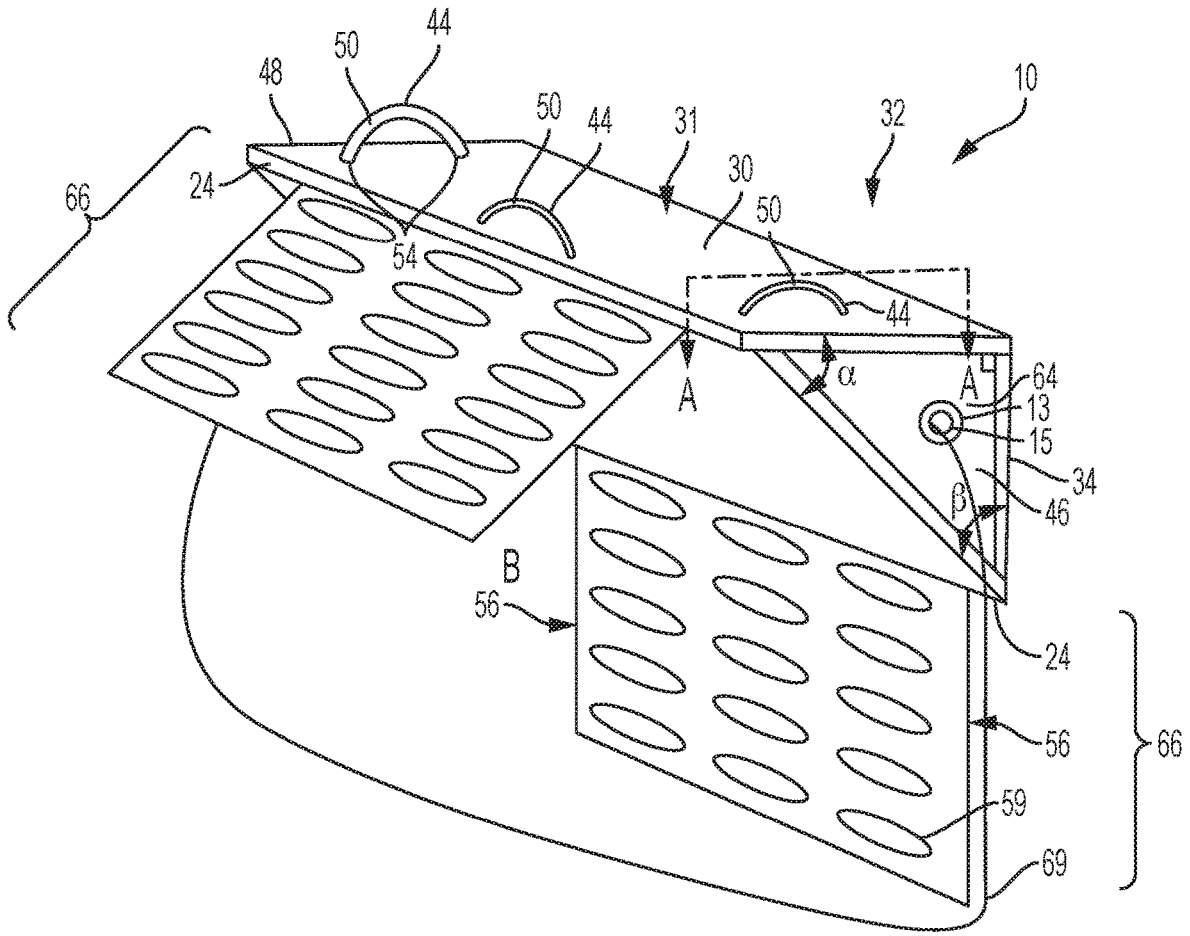
FIG. 10 is a perspective view of a seventh embodiment of a roofing support system and roof support as disclosed herein.

As also illustrated in FIG. 10, composite roofing support system 10 and roofing support 32 may also include a longitudinally-extending flexible sheet 58 or web. Flexible sheet 58 may extend along the entire length of roofing support 32, or along only a portion of the length, such as, for example, one quarter to three quarters of the length. Flexible sheet 58 may be formed from any suitable flexible material, including various metals, polymers including reinforced polymers, composite materials, rubbers including natural and synthetic rubbers, or fabric and may be attached to the composite roofing support system 10 by any suitable fastener or attachment mechanism. The sheet 58 or web may be solid or perforated. In one embodiment, the sheet 58 comprises a high strength woven or nonwoven fabric, such as various polymer fabrics, including nylon fabrics, such as various rip-stop or ballistic nylon fabrics. In another embodiment, sheet 58 or web may include a solid or perforated plastic sheet with perforations 59 that may or may not be reinforced, such as those frequently used for snow-fencing, for example. The sheet 58 may include a sheet anchor 64 at one end and be embedded in the composite roofing support system 10 in the locations described, and in one embodiment may be inserted into a mold for the core member 12 and molded with the sheet anchor 64 or anchors embedded within the core member 12 with a portion of the sheet 58 protruding and extending outwardly away from the member. In the case of perforated sheets 58, the perforations act as multiple anchors 64 as the core material is molded it flows through the perforations anchoring the sheet within the core member upon solidification or polymerization. The sheet 58 may be any suitable overall length and will define a portion 66 that extends or protrudes from the member. The portion 66 may have any suitable length, including 0.5 to 30 feet, and more particularly 1 to 15 feet, and even more particularly 1 to 6 feet, and yet more particularly 1 to 3 feet, and may have any suitable width or thickness, including widths of 8 to 30 inches, more particularly 12 to 30 inches, and thicknesses of 0.05 to 0.35 inches, more particularly 0.10 to 0.25 inches. In embodiments in which the roofing support 32 is fixed to the roof 36 and that include a hollow reinforcement 13, such as a tube or pipe, the reinforcement 13 may be used as a conduit to pass a strap or rope 69 through. The strap or rope 69 may be formed to provide a continuous loop or have free ends joined to form a loop, and the loop may be used to extend on the downslope of the roof away from the support and act as an additional safety device. For example, in the event of a slip, trip, stumble, or other event knocking the worker off from the support, a roofing worker can grab onto the strap or rope 69 to prevent tumbling or sliding off of the roof. This is very advantageous because it is well-known in the roofing arts that it is very difficult to prevent falling off of a steeply pitched roof (e.g. 8/12 slope or greater) in the circumstances described once an accidental loss of balance occurs.

Figure 11:
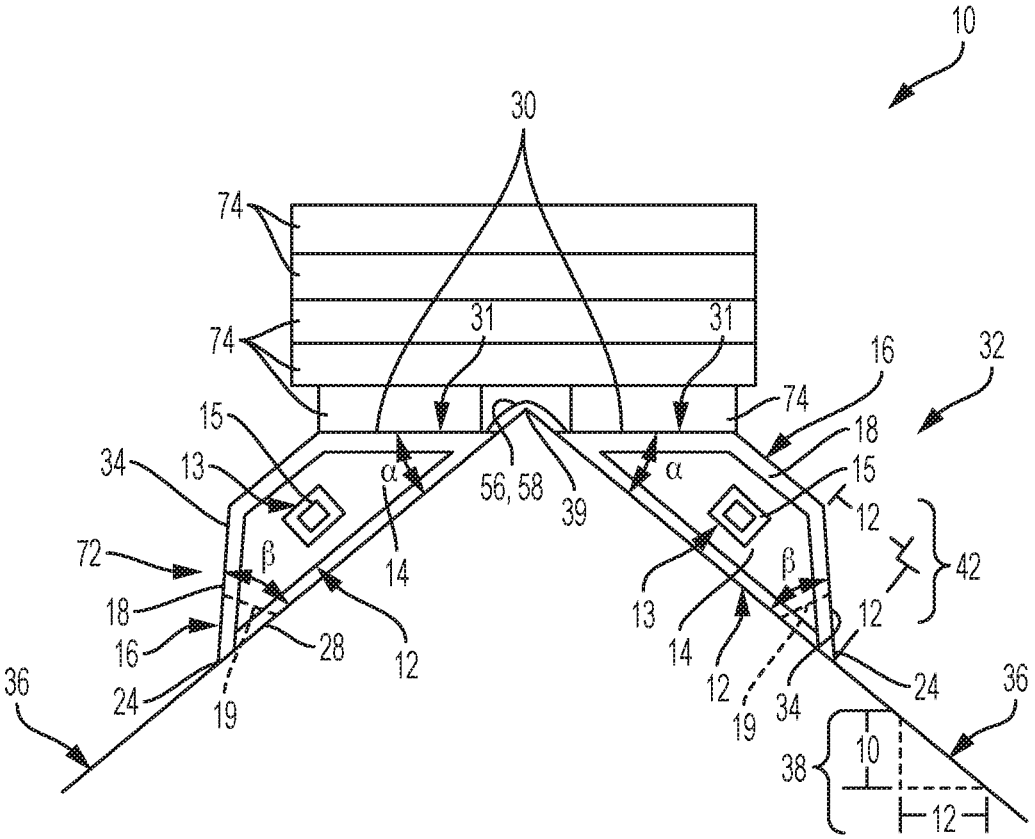
FIG. 11 is an end plan view of an eighth embodiment of a roofing support system and roof supports as disclosed herein.

As illustrated in FIG. 11, roof support system 10 and roof supports 32, 72 may have any suitable cross-sectional shape so long as it matches the pitch of a roof 36 to provide at least one, and preferably at least two, substantially horizontal work surfaces 31, 33, as described herein. In one embodiment, the roofing support system 10 and first roofing support 32 comprises a third side 34 and fourth side 35, and the wedge-shaped lateral cross-section comprises a generally or substantially trapezoidal-shaped cross-section, including a generally or substantially right, acute, or scalene trapezoidal-shaped cross-sections, with the third side 34 opposite the second side 30. A first predetermined angle ($\alpha$) formed by the convergence of first side 28 and second side 30. A second predetermined angle ($\beta$) formed by the convergence of the first side 28 and third side 34, such that where $\alpha$ and $\beta$ are different angles, the angles can be selected to match two different predetermined roof pitches and provide a substantially horizontal first side 28 or third side 34 by simply reversing the upslope side of the support and aligning it parallel with the peak 39 of roof having the same predetermined roof angle (i.e. when the angle or slope of the roof is measured from horizontal). In this context, generally or substantially trapezoidal includes embodiments where one or more of the vertices of the first predetermined angle ($\alpha$) and/or second predetermined angle ($\beta$) are truncated (as illustrated by phantom lines 19 in FIG. 11 proximate the point where the vertex would have occurred such that the converging sides do not actually intersect to form the vertex, or shapes that include one or more radii (e.g. $r_1$, $r_2$ not shown) in place of the vertices (i.e. a rounded trapezoidal shape), but where one of ordinary skill would readily recognize a generally or substantially trapezoidal shaped cross-sectional form. In another embodiment, the first side 28 and second side 30 taper toward one another at a first predetermined acute angle ($\alpha$) and the first side 28 and the third side 34 taper toward one another at a second predetermined acute angle ($\beta$) that is different than the first predetermined acute angle ($\alpha$). In one embodiment, as shown in FIG. 11, the roofing support system 10 has an acute trapezoidal cross-sectional shape and the first predetermined acute angle ($\alpha$) is selected so that when the first side 28 is placed with the first predetermined acute angle ($\alpha$) converging upslope against a first roof 36 having a first pitch 38 the second surface 30 is substantially horizontal and the second predetermined acute angle ($\beta$) is selected so that, in another embodiment of roof, when the first side 28 is placed with the second predetermined acute angle ($\beta$) converging upslope against a second roof 40 and roof deck 41 having a second pitch 42 (not shown) the third side 34 is substantially horizontal, and wherein the first pitch 38 and the second pitch 42 are different, and wherein one of a convergence of the first side and second side or a convergence of the first side and the third side comprises the thin edge 24 of the wedge. As used herein substantially horizontal includes horizontal, as well as small angular deviations from horizontal either toward or away from the roof, when the device is placed parallel to the peak 39 on a roof 37 having the respective first pitch or second pitch for which the device has been designed. In this context, small angular deviations may include 0.05 to 5 degrees, and more particularly 0.05 to 2 degrees.

Figure 12:
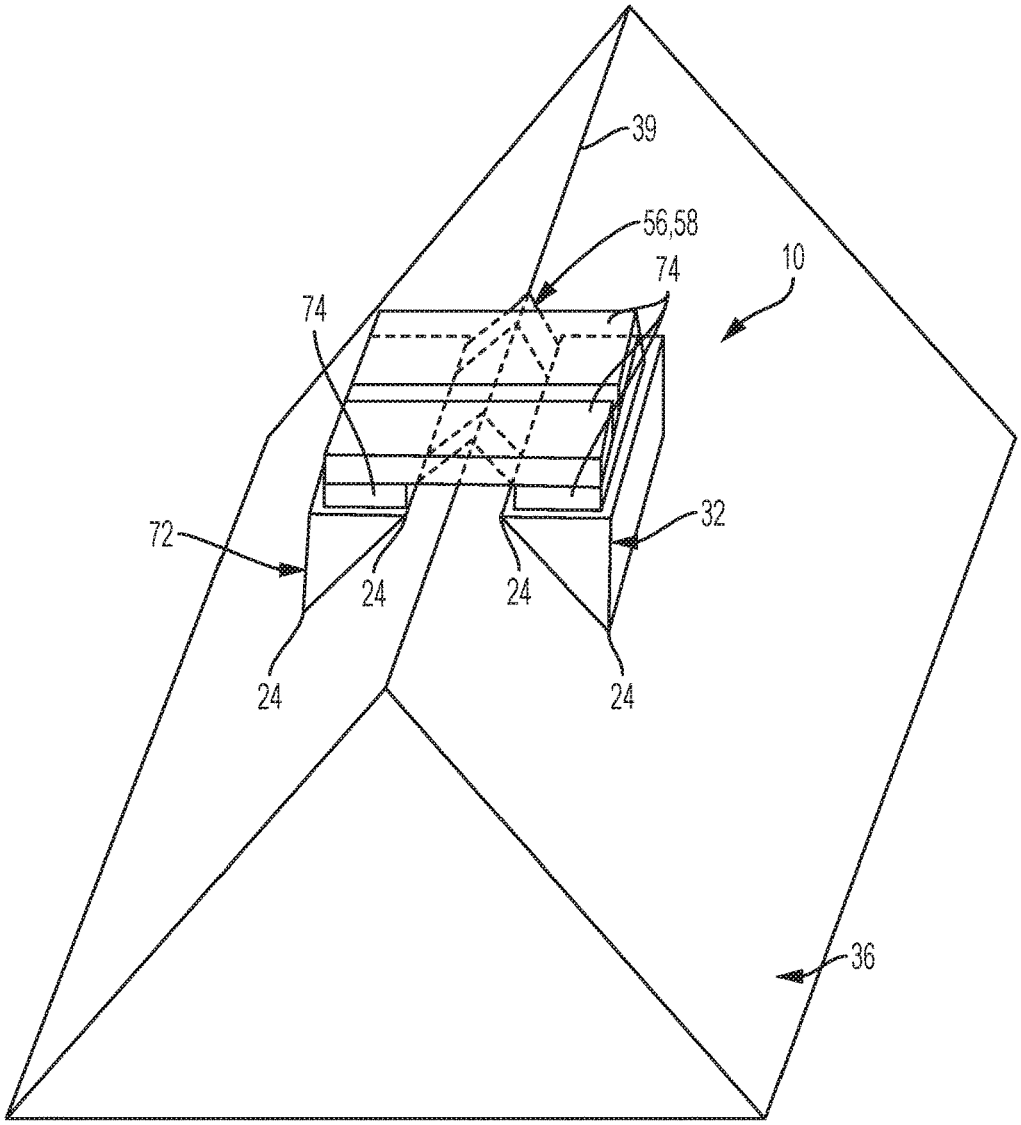
FIG. 12 is a perspective view of an embodiment of a roof and roofing support system and roof supports as disclosed herein and a method of using the system.
Figure 13:
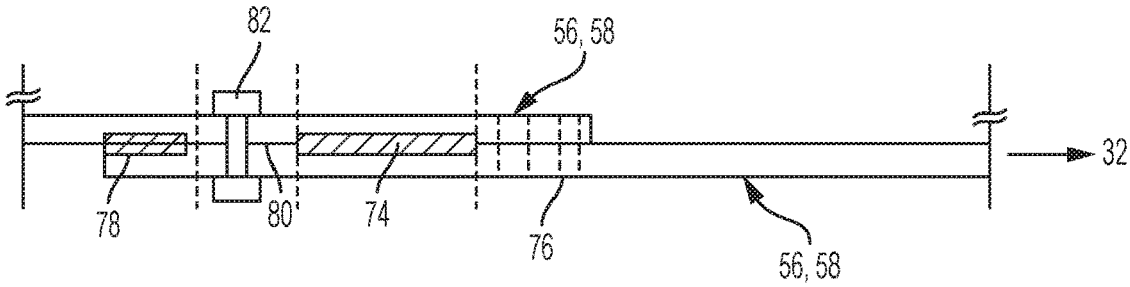
FIG. 13 is cross-sectional view of an embodiment of strap or sheet joints as disclosed herein.

As shown in FIGS. 11 and 12, in one embodiment the composite roofing support system 10 further includes a second roofing support 72 that is substantially identical to first roofing support 32 and may include the features in the embodiments described above. The second roofing support 72 may be positioned spaced apart and opposite and as a mirror image of the first roofing support 32 with the respective thin edges 24 of the wedges facing one another, the respective first sides 28 facing in the same direction, and each may include, for example, the respective at least one flexible strap or flexible sheet, each with a free end, wherein the respective free ends are joined to one another with any suitable joint or connector. As shown in FIG. 13, this may include, for example, joints such as a glue joint 74, a sewn joint 76, a weld joint 78, a joint 80 formed by one or more fasteners 82 such as one or more rivet 82 or snap fastener, or a connector such as one or more buckle, hasp or cinch (see FIG. 8A) including those having any known configuration that interlock one free end of a belt or strap to another belt or strap.

As shown in FIGS. 11 and 12, in another embodiment the composite roofing support system 10 further includes a second roofing support 72 that is substantially identical to first roofing support 32 and may include the features in the embodiments described above. The second roofing support 72 may be positioned opposite and as a mirror image of first roofing support 32 with the respective thin edges 24 of the wedges facing one another, the respective first sides 28 facing in the same direction, and each include the respective at least one flexible strap or flexible sheet, wherein the first roofing support 32 and 72 second roofing support share the same at least one flexible strap or flexible sheet. As shown in FIGS. 11 and 12, this may be accomplished, for example, where the core members 12 are molded simultaneously with a single strap or sheet shared between them, or where one core member is molded together with the strap or sheet, and then the strap or sheet is inserted into the mold for the other core member and subsequently molded into the core member.

Figure 14:
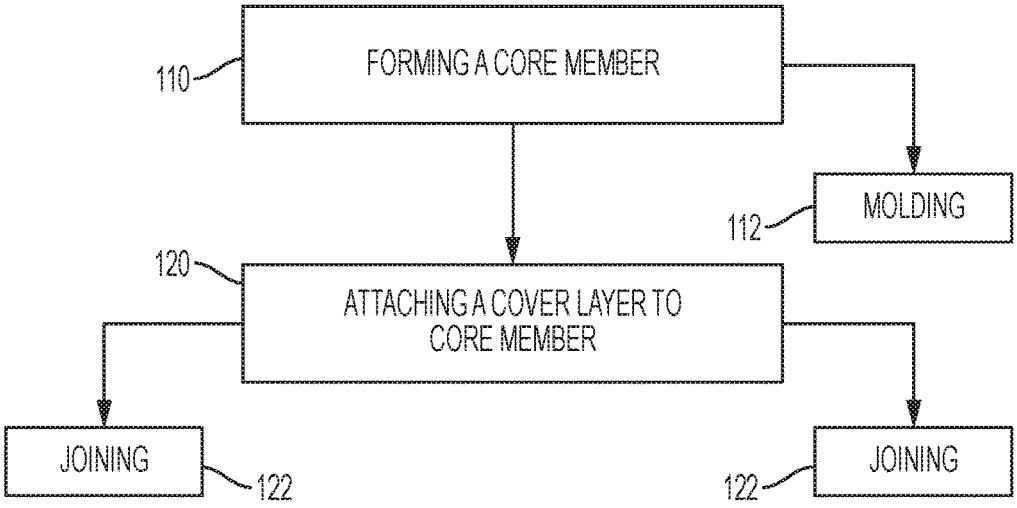
FIG. 14 is a flowchart of a method of making a roofing support system and roof support as disclosed herein.

In one embodiment shown in FIG. 14, a method of making 100 a lightweight composite roofing support system is disclosed. The method 100 includes forming 110 a longitudinally-extending core member 12 having a wedge-shaped lateral cross-section, a thin edge, a thick edge, a first side, and a second side, the first side and the second side tapering toward one another at the thin edge in a predetermined first acute angle ($\alpha$), the core member comprising a core material 14. Forming 110 may include various forms of molding 112 an engineering thermoset or thermoplastic polymer of the core material 14 into the shapes described herein. The method 100 also includes attaching 120 a cover layer 16 comprising a cover material 18, the cover layer disposed on and covering at least one of the first side 28 and the second side 30, the cover material being substantially more compressible than the core material, the core member and cover layer comprising a first roofing support 32. In one embodiment, attaching 120 comprises adhering or otherwise joining 122 a discreetly formed cover layer 16 to the first side 28, second side 30, and/or third side 32 or additional sides as described herein. In another embodiment, attaching 120 may comprise molding 124 cover layer 16 onto the first side 28, second side 30, and/or third side 32 or additional sides as described herein. Molding 124 may include any suitable form of molding, including insert molding where the core member 12 is inserted into a mold designed to provide cover layer 16, and/or co-molding of the cover layer 16 onto the core member 12 in conjunction with a multi-shot molding operation in a single mold, for example.

Figure 15:
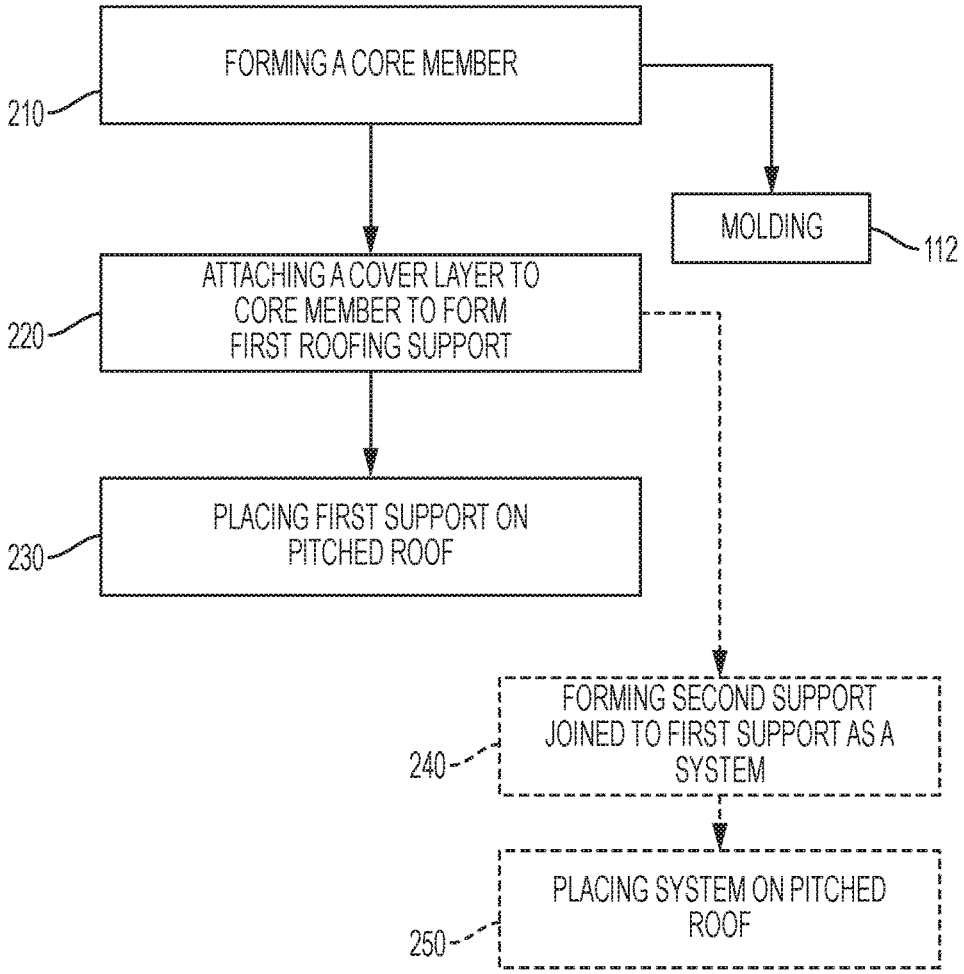
FIG. 15 is a flowchart of a method of using a roofing support system and roof support as disclosed herein.

As illustrated in FIG. 15, in one embodiment, a method of using 200 a lightweight composite roofing support system 10 is disclosed. The method of using 200 includes forming 210 a longitudinally-extending core member 32 having a wedge-shaped lateral cross-section, a thin edge 24, a thick edge 26, a first side 28, and a second side 30, the first side and the second side tapering toward one another at the thin edge 24 in a predetermined first acute angle ($\alpha$), the core member comprising a core material 14, which may be the same as forming 110 as described above. The method of using 200 also includes attaching 220 a cover layer 16 comprising a cover material 18, the cover layer disposed on and covering the first side 28 and the second side 30, the cover material being substantially more compressible than the core material, the core and cover comprising a first roofing support 32, which may be the same as attaching 120 described above. The method of using 200 also includes placing 230 the first roofing support 32 on a pitched roof 36, 40 and configuring the system so that one of the first side 28 or the second side provides a substantially horizontal, non-skid, work surface configured to hold a predetermined roofing load 4, which may include the weight of a person, or the weight of a roofing material, such as a bundle of shingles, or a combination thereof. In one embodiment, the method of using 200 also includes forming 240 a second roofing support 72 substantially identical to and facing the first roofing support 32 with the respective thin edges facing one another, the respective first sides 28 facing the same direction, and, in one embodiment, having the respective at least one flexible strap 56 or flexible sheet 58 joined to one another or forming a continuous whole. In other embodiments (FIG. 2), the first roofing support 32 and second roofing support 72 need not be joined to one another and may be separately fixed to the roof deck 37. This method also includes placing 250 the first roofing support 32 and second roofing support 72 as a support system 10 over the peak 39 of a roof 36, wherein the respective work surfaces are configured to support a predetermined roof load 4, such as a plurality of bundles of shingles 74.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of items is applied to all of the listed items, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the components or elements described herein specifically discloses and includes the embodiments that "consist essentially of" the named components (i.e., contain the named components and no other components that significantly adversely affect the basic and novel features disclosed), and embodiments that "consist of" the named components (i.e., contain only the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A lightweight composite roofing support system, comprising:

a longitudinally-extending core member having a wedge-shaped lateral cross-section comprising a truncated triangular shape, a first roof contact side, a second side comprising a second side working surface having a second width and a second length that is greater than the second width, the first roof contact side and the second side tapering toward one another at a first predetermined acute angle (α), and a third side comprising a third side working surface having a third width and a third length that is greater than the third width, the first roof contact side and the third side tapering toward one another at a second predetermined acute angle (β) that is different than the first predetermined acute angle (α), the core member comprising a core material; and a cover layer comprising a cover material, the cover layer disposed on and covering at least the first roof contact side, the cover material being substantially more compressible than the core material, the core member and cover layer comprising a first roofing support, wherein the core member comprises a longitudinally-extending molded shell and a longitudinally-extending base attached to the molded shell by an attachment, the base having the cover layer disposed on a lower surface thereof, wherein the longitudinally-extending molded shell comprises the second side, the third side, a first end, and an opposed second end, the first end and the second end attached to respective opposed ends of the second side and the third side, wherein the base and cover layer disposed thereon comprises the first roof contact side and is attached to respective lower portions of the second side, third side, first end, and opposed second end, and wherein the longitudinally-extending molded shell comprises a flange disposed on the lower portions of the second side, third side, first end, and opposed second end, the flange defining a pocket configured to receive the base and cover layer disposed thereon.

2. The roofing support system of claim 1, wherein the cover layer is disposed on the core member by a permanent joint or a removable joint.

3. The roofing support system of claim 1, wherein the second side working surface comprises a substantially horizontal second side platform configured to support a predetermined roofing load comprising a roofing worker or a roofing material when the first roof contact side is disposed on a first roof comprising a first predetermined roof pitch with the first predetermined acute angle converging upslope, and the third side working surface comprises a substantially horizontal third side platform configured to support the predetermined roofing load when the first roof contact side is disposed on a second roof comprising a second predetermined roof pitch with the second predetermined acute angle converging upslope, and wherein the first pitch and the second pitch are different.

4. The roofing support system of claim 1, wherein the longitudinally-extending molded shell comprises a plurality of attachment structures disposed on the flange.

5. The roofing support system of claim 4, wherein the attachment structures comprise a plurality of lugs having a plurality of openings therethrough that are configured to receive a plurality of fasteners configured for attachment to a roof deck.

6. The roofing support system of claim 1, wherein the longitudinally-extending molded shell comprises a plurality of laterally extending internal ribs disposed on a lower surface of the second side and the third side.

7. A lightweight composite roofing support system, comprising:

a longitudinally-extending core member having a wedge-shaped lateral cross-section comprising a truncated triangular shape, a first roof contact side, a second side comprising a second side working surface having a second width and a second length that is greater than the second width, the first roof contact side and the second side tapering toward one another at a first predetermined acute angle (α), and a third side comprising a third side working surface having a third width and a third length that is greater than the third width, the first roof contact side and the third side tapering toward one another at a second predetermined acute angle (β) that is different than the first predetermined acute angle (α), the core member comprising a core material; and a cover layer comprising a cover material, the cover layer disposed on and covering at least the first roof contact side, the cover material being substantially more compressible than the core material, the core member and cover layer comprising a first roofing support, wherein the core member comprises a longitudinally-extending molded shell and a longitudinally-extending base attached to the molded shell, the base having the cover layer disposed on a lower surface thereof, wherein the base comprises a selectively attachable and detachable attachment, and wherein the longitudinally-extending molded shell comprises a plurality of bores extending through the first side and the third side, the bores configured to receive a plurality of selectively attachable and detachable base fasteners that are configured to provide the selectively attachable and detachable attachment.

8. The roofing support system of claim 7, wherein an uppermost surface of the first side, the third side, or both, comprises a non-skid surface.

9. The roofing support system of claim 1, wherein the core material comprises an engineering thermoset or thermoplastic polymer and the cover material comprises an open cell or closed cell foam.

10. The roofing support system of claim 9, wherein the core material comprises polyethylene, polystyrene or polyurethane.

11. A method of making a lightweight composite roofing support system, comprising:

forming a longitudinally-extending core member having a wedge-shaped lateral cross-section comprising a truncated triangular shape, a first roof contact side, a second side comprising a second side working surface having a second width and a second length that is greater than the second width, the first roof contact side and the second side tapering toward one another at a first predetermined acute angle (α), and a third side comprising a third side working surface having a third width and a third length that is greater than the third width, the first roof contact side and the third side tapering toward one another at a second predetermined acute angle (β) that is different than the first predetermined acute angle (α), the core member comprising a core material; and attaching a cover layer comprising a cover material to the core member, the cover layer disposed on and covering at least the first roof contact side, the cover material being substantially more compressible than the core material, the core member and cover layer comprising a first roofing support, wherein the core member comprises a longitudinally-extending molded shell and a longitudinally-extending base attached to the molded shell by an attachment, the base having the cover layer disposed on a lower surface thereof, wherein the longitudinally-extending molded shell comprises the second side, the third side, a first end, and an opposed second end, the first end and the second end attached to respective opposed ends of the second side and the third side, wherein the base and cover layer disposed thereon comprises the first roof contact side and is attached to respective lower portions of the second side, third side, first end, and opposed second end, and wherein the longitudinally-extending molded shell comprises a flange disposed on the lower portions of the second side, third side, first end, and opposed second end, the flange defining a pocket configured to receive the base and cover layer disposed thereon.

12. The method of claim 11, wherein forming the core member comprises molding an engineering thermoset or thermoplastic polymer, and attaching comprises adhering the cover material onto the core member or molding the cover material onto the core member to form the cover layer.

13. A method of using a lightweight composite roofing support system, comprising:

forming a longitudinally-extending core member having a wedge-shaped lateral cross-section comprising a truncated triangular shape, a first roof contact side, a second side comprising a second side working surface having a second width and a second length that is greater than the second width, the first roof contact side and the second side tapering toward one another at a first predetermined acute angle (α), and a third side comprising a third side working surface having a third width and a third length that is greater than the third width, the first roof contact side and the third side tapering toward one another at a second predetermined acute angle (β) that is different than the first predetermined acute angle (α), the core member comprising a core material;

attaching a cover layer comprising a cover material to the core member, the cover layer disposed on and covering at least the first roof contact side, the cover material being substantially more compressible than the core material, the core member and cover layer comprising a first roofing support, wherein the core member comprises a longitudinally-extending molded shell and a longitudinally-extending base attached to the molded shell by an attachment, the base having the cover layer disposed on a lower surface thereof, wherein the longitudinally-extending molded shell comprises the second side, the third side, a first end, and an opposed second end, the first end and the second end attached to respective opposed ends of the second side and the third side, wherein the base and cover layer disposed thereon comprises the first roof contact side and is attached to respective lower portions of the second side, third side, first end, and opposed second end, and wherein the longitudinally-extending molded shell comprises a flange disposed on the lower portions of the second side, third side, first end, and opposed second end, the flange defining a pocket configured to receive the base and cover layer disposed thereon; and placing the first roofing support on a pitched roof and configuring the system so that one of the first side or the second side provides a substantially horizontal work surface configured to hold a predetermined roofing load.

14. The method of claim 13, wherein placing comprises disposing the first roofing support proximate a peak of the roof on one side of the roof with the first predetermined acute angle (α) facing the peak, the method further comprising:

forming a second roofing support substantially identical to the first roofing support;

placing the second roofing support opposite the first roofing support over the peak on another side of the roof with the first predetermined acute angle (α) facing the peak.

15. The method of claim 14, further comprising disposing a predetermined roofing load on both the first roofing support and the second roofing support above the peak.

* * * * *